US010780720B2

(12) United States Patent
Takagiwa

(10) Patent No.: US 10,780,720 B2
(45) Date of Patent: Sep. 22, 2020

(54) PLATEN CONVEYANCE DEVICE AND PLATEN MOVING DEVICE

(71) Applicant: BROTHER KOGYO KABUSHIKI KAISHA, Nagoya-shi, Aichi-ken (JP)

(72) Inventor: Yutaka Takagiwa, Kariya (JP)

(73) Assignee: BROTHER KOGYO KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 16/367,777

(22) Filed: Mar. 28, 2019

(65) Prior Publication Data

US 2019/0299663 A1 Oct. 3, 2019

(30) Foreign Application Priority Data

Mar. 30, 2018 (JP) ..... 2018-070397

(51) Int. Cl.
*B41J 11/02* (2006.01)
*D06P 5/30* (2006.01)
*B41J 3/407* (2006.01)

(52) U.S. Cl.
CPC ..... *B41J 11/02* (2013.01); *B41J 3/4078* (2013.01); *D06P 5/30* (2013.01)

(58) Field of Classification Search
CPC ..... B41J 11/02; B41J 3/4078; B41J 11/06; D06P 5/30
See application file for complete search history.

(56) References Cited

U.S. PATENT DOCUMENTS

2009/0102869 A1* 4/2009 Niimi ..... B41J 3/28 347/2

FOREIGN PATENT DOCUMENTS

JP 2015-113532 A 6/2015

* cited by examiner

*Primary Examiner* — Henok D Legesse
(74) *Attorney, Agent, or Firm* — K&L Gates LLP

(57) ABSTRACT

A platen conveyance device includes a platen, a first platen support portion, a first conveyance path, a second platen support portion, a second conveyance path, and a platen moving portion. The platen includes a neckline guide portion. The first platen support portion supports the platen. The first conveyance path movably guides the first platen support portion in a first direction. The second platen support portion supports the platen. The second conveyance path movably guides the second platen support portion in the first direction. The platen moving portion moves the platen, which is supported by one of the first platen support portion and the second platen support portion with the neckline guide portion positioned on a first side in the first direction, to the other of the first platen support portion and the second platen support portion with the neckline guide portion positioned on the first side.

13 Claims, 19 Drawing Sheets

PLATEN CONVEYANCE DEVICE AND PLATEN MOVING DEVICE

CROSS-REFERENCE TO RELATED APPLICATION

This application claims priority to Japanese Patent Application No. 2018-070397 filed on Mar. 30, 2018, the disclosure of which is herein incorporated by reference in its entirety.

BACKGROUND

The present disclosure relates to a platen conveyance device and a platen moving device.

A print device is known that performs print processing on a recording medium such as a cloth. After ejecting white ink onto an area on which an image is to be formed, the print device forms the image by ejecting color inks.

SUMMARY

As a pre-treatment in order to enhance color development of the inks, for example, a pretreatment agent is sometimes applied to the cloth, and a heat treatment is performed on the cloth to which the pretreatment agent has been applied. Further, after forming the image using the inks, the heat treatment is sometimes performed as an after-treatment on the cloth, in order to fix the inks on the cloth. A cleaning treatment, in which the cloth is washed, is also sometimes performed as the after-treatment.

In general, the plurality of processes including the pre-treatment, the print processing, and the after-treatment are respectively performed by separate devices. For example, the pretreatment is performed using a pretreatment device, and the after-treatment is performed using an after-treatment device. As a result, in the plurality of processes, an operator needs to set the cloth onto and remove the cloth from each of the devices. When the cloth is a shirt, if the shirt is not set onto each of the devices such that the neckline is on a near side, the setting and removal of the shirt becomes difficult.

Various embodiments of the general principles described herein provide a platen conveyance device and a platen moving device capable of reducing time and effort to set and remove a shirt in each of a plurality of processes, and allowing setting and removal in which a neckline of the shirt is on the near side.

Embodiments herein provide a platen conveyance device including a platen, a first platen support portion, a first conveyance path, a first processing portion, a second platen support portion, a second conveyance path, a second processing portion, and a platen moving portion. The platen includes a neckline guide portion configured to support a neckline of a shirt and configured to guide a position of the neckline of the shirt. The first platen support portion is configured to support the platen. The first conveyance path is configured to movably guide the first platen support portion in a first direction. The first processing portion is positioned partway along the first conveyance path and is configured to perform first processing on the shirt. The second platen support portion is configured to support the platen. The second conveyance path is configured to movably guide the second platen support portion in the first direction. The second processing portion is positioned partway along the second conveyance path and is configured to perform, on the shirt, second processing that is different from the first processing by the first processing portion. The platen moving portion is configured to move the platen, which is supported by one of the first platen support portion and the second platen support portion with the neckline guide portion positioned on a first side in the first direction, to the other of the first platen support portion and the second platen support portion with the neckline guide portion positioned on the first side.

Embodiments herein also provide a platen moving device configured to be attached to a platen conveyance device. The platen conveyance device includes a platen, a first platen support portion, a first conveyance path, a first processing portion, a second platen support portion, a second conveyance path, and a second processing portion. The platen includes a neckline guide portion configured to support a neckline of a shirt and is configured to guide a position of the neckline of the shirt. The first platen support portion is configured to support the platen. The first conveyance path is configured to movably guide the first platen support portion in a first direction. The first processing portion is positioned partway along the first conveyance path and is configured to perform first processing on the shirt. The second platen support portion is configured to support the platen. The second conveyance path is configured to movably guide the second platen support portion in the first direction. The second processing portion is positioned partway along the second conveyance path and is configured to perform, on the shirt, second processing that is different from the first processing by the first processing portion. The platen moving device includes a platen moving portion. The platen moving portion is configured to move the platen, which is supported by one of the first platen support portion and the second platen support portion with the neckline guide portion positioned on a first side in the first direction, to the other of the first platen support portion and the second platen support portion with the neckline guide portion positioned on the first side.

BRIEF DESCRIPTION OF THE DRAWINGS

Embodiments will be described below in detail with reference to the accompanying drawings in which.

DETAILED DESCRIPTION

Figure 1:
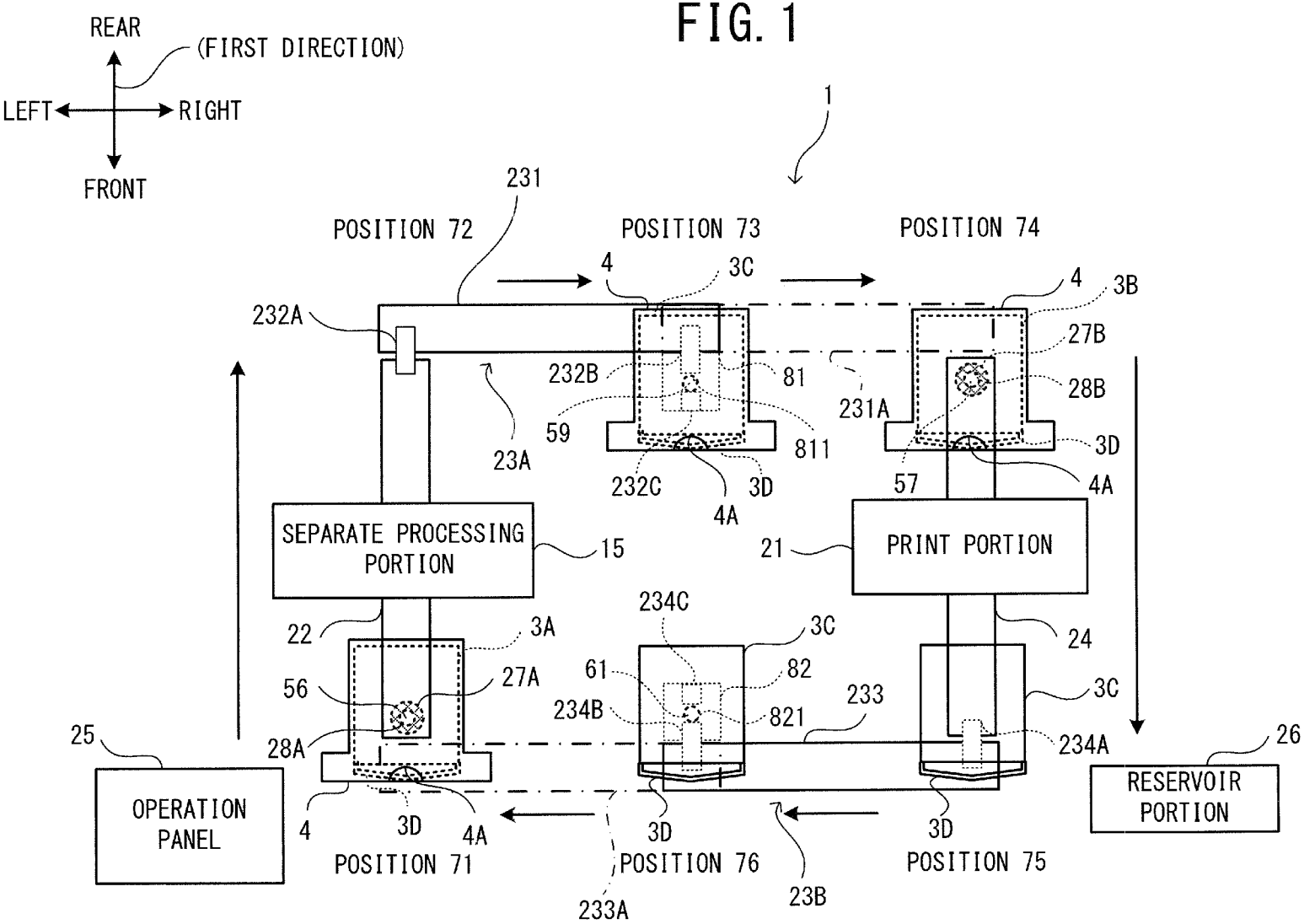
FIG. 1 is a diagram showing a configuration example of a print device 1.

Hereinafter, each embodiment of the present disclosure will be explained with reference to the drawings. Front and rear, and right and left directions shown by arrows in the drawings are used in the following explanation. Further, a near side and a depth side on the page are respectively an upward direction and a downward direction. The front-rear direction (a conveyance direction) is hereinafter referred to as a "first direction."

First Embodiment

A first embodiment will be explained with reference to FIG. 1 to FIG. 8. As shown in FIG. 1, a print device 1 according to the first embodiment is provided with a separate processing portion 15 and a print portion 21. The print device 1 performs, on a shirt 4 that is an example of a processing medium, separate processing using the separate processing portion 15, and print processing using the print portion 21, in that order.

[Schematic Configuration of Print Device 1]

A schematic configuration of the print device 1 will be explained with reference to FIG. 1 to FIG. 3B. The print device 1 is provided with platens 3A to 3C, the separate processing portion 15, a first platen moving portion 23A, the print portion 21, a second platen moving portion 23B, an operation panel 25, a reservoir portion 26, and the like.

[Platens 3A to 3C]

Figure 2A:
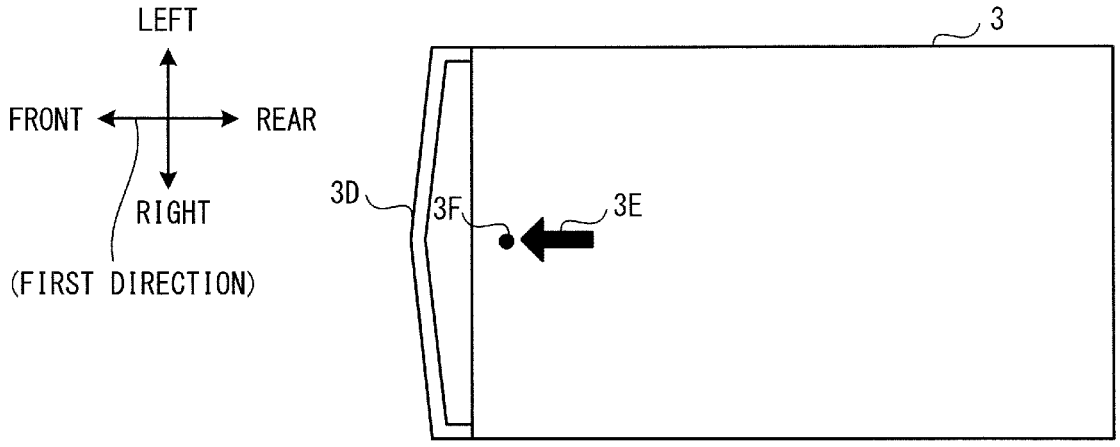
FIG. 2A is a top view of a platen 3.

The platens 3A to 3C will be explained with reference to FIG. 2A, FIG. 2B, and FIG. 2C. As shown in FIG. 2A, the platens 3A to 3C are substantially rectangular plate-shaped members that are long in the first direction. The platen 3A is a platen that is guided by a first conveyance path 22 (refer to FIG. 1). The platen 3B is a platen that is guided by a second conveyance path 24 (refer to FIG. 1). The platen 3C is a platen that is moved by the first platen moving portion 23A (refer to FIG. 1) or the second platen moving portion 23B (refer to FIG. 1). Hereinafter, when there is not particular need to distinguish between the platens 3A to 3C, they are referred to simply as the "platen 3" or the "platens 3."

As shown in FIG. 2A, the platen 3 is provided with a neckline support portion 3D, an arrow 3E, and a marker 3F. Note that it is sufficient that the platen 3 be provided with at least one of the neckline support portion 3D, the arrow 3E, and the marker 3F. The shirt 4 is mounted on the platen 3 such that a neckline 4A of the shirt 4 is on the front side. The neckline support portion 3D supports the neckline 4A of the shirt 4. The neckline support portion 3D guides the neckline 4A of the shirt 4. The neckline support portion 3D has a hanger shape, for example, and is provided on the front side of the platen 3. The arrow 3E is an arrow pointing to a position of the neckline 4A of the shirt 4 on the platen 3. The marker 3F is a marker indicating a position of the neckline 4A of the shirt 4 on the platen 3. The arrow 3E and the marker 3F guide the position of the neckline 4A of the shirt 4 on the platen 3. The arrow 3E is, for example, provided at the center of the top surface of the platen 3 and on the front side of the platen 3, and points to the frontward direction. The marker 3F is provided at the center of the top surface of the platen 3 and on the front side of the platen 3.

Figure 2B:
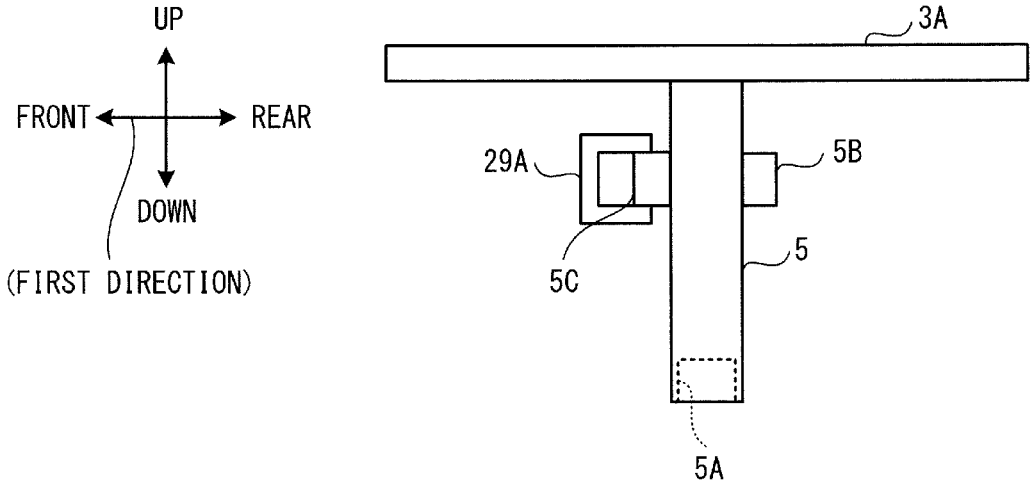
FIG. 2B is a schematic right side view of a platen 3A.
Figure 2C:
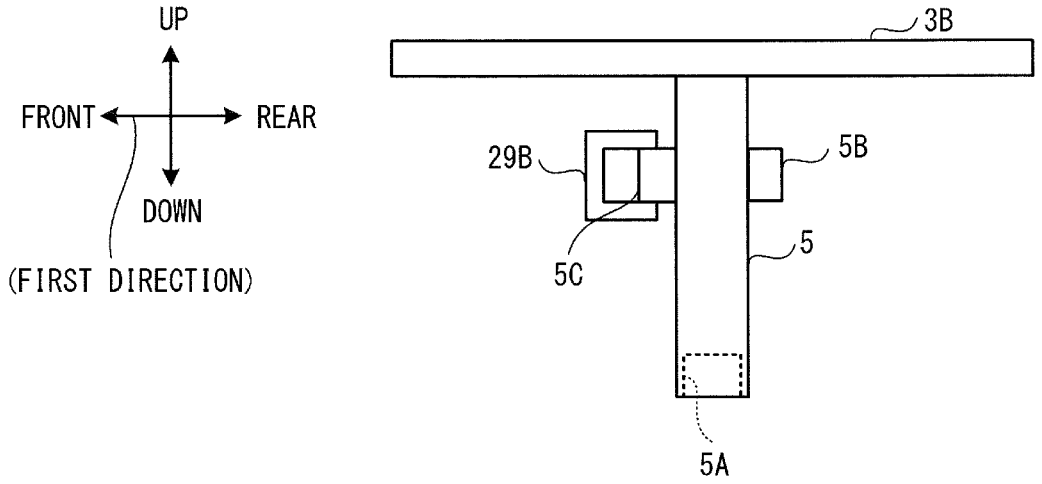
FIG. 2C is a schematic right side view of a platen 3B.

As shown in FIG. 2B, the platen 3 is provided with a shaft 5. The shaft 5 extends downward from substantially the center of the bottom surface of the platen 3. The shaft 5 has a recessed portion 5A, a first clamped portion 5B, and a second clamped portion 5C. The recessed portion 5A is formed in the bottom surface of the shaft 5. The first clamped portion 5B is provided on the outer periphery on the rear side of the shaft 5, for example, and has a substantially cuboid shape. The first clamped portion 5B is clamped between a first chuck 232A and a second chuck 232B of the first platen moving portion 23A. The second clamped portion 5C is provided on the outer periphery on the front side of the shaft 5, for example, and has the same shape as the first clamped portion 5B. The second clamped portion 5C is clamped between a chuck 29A of a first platen support portion 27A to be described later and a chuck 29B of a second platen support portion 27B to be described later. Distances from the top surface of the platen 3 to the top end of the first clamped portion 5B and to the top end of the second clamped portion 5C are the same. Further, distances from the top surface of the platen 3 to the bottom end of the first clamped portion 5B and to the bottom end of the second clamped portion 5C are the same.

[Separate Processing Portion 15]

The separate processing portion 15 will be explained with reference to FIG. 1. The separate processing portion 15 performs separate processing that is different to the print processing. The separate processing is, for example, a pretreatment, such as application processing, heat treatment, and the like. The application processing is processing to apply a pretreatment agent, which improves the color development of color inks. The heat treatment is processing that applies heat to the shirt 4 to which the pretreatment agent has been applied. Further, the separate processing is, for example, an after-treatment, such as heat treatment of the shirt 4 after an image has been formed, cleaning treatment of the shirt 4, and the like.

The separate processing portion 15 is provided with the first conveyance path 22, the first platen support portion 27A, and the like. The first conveyance path 22 extends in the first direction, and guides the first platen support portion 27A so as to be movable in the first direction. The first conveyance path 22 is provided, for example, with a belt (not shown in the drawings), a guide rail (not shown in the drawings), and the like. The belt is an endless belt and is stretched around pulleys (not shown in the drawings) that are rotatably supported at both end portions, in the first direction, of the bottom surface of the first conveyance path 22. The belt moves the first platen support portion 27A in the first direction along the guide rail due to rotational driving of a first conveyance motor 54 (refer to FIG. 4). The first conveyance motor 54 is a stepping motor, for example.

[First Platen Support Portion 27A]

The first platen support portion 27A will be explained with reference to FIG. 1, FIG. 2A, FIG. 2B, and FIG. 2C. The first platen support portion 27A supports the platen 3A. The first platen support portion 27A is provided with a hole 28A, a first lift 56, the chuck 29A, and the like. The hole 28A is provided in the top surface of the first platen support portion 27A, and extends in the downward direction. The shaft 5 of the platen 3A can be inserted into the hole 28A.

The first lift 56 is provided inside the hole 28A. The first lift 56 is an air cylinder, for example. The top end portion of the first lift 56 is inserted into the recessed portion 5A of the shaft 5 of the platen 3A, and the platen 3A is supported such that the platen 3A can be raised and lowered (can move up and down).

The chuck 29A is provided in a position at which the chuck 29A can clamp the second clamped portion 5C of the shaft 5 of the platen 3. In this case, the shaft 5 is inserted into the hole 28A in the top surface of the first platen support portion 27A. In other words, in a state in which the shaft 5 is inserted into the hole 28A, the chuck 29A is provided in a position facing the second clamped portion 5C of the platen 3. An opening and closing direction of the chuck 29A is the up-down direction, for example. The chuck 29A is open toward the rearward direction, for example. The chuck 29A clamps the second clamped portion 5C of the platen 3 at least during a period in which the first platen support portion 27A is being moved in the first direction. When the chuck 29A is in an open state, the shaft 5 of the platen 3A can be raised or lowered by the first lift 56. The first lift 56 raises the shaft 5 of the platen 3A as far as a position at which the shaft 5 can be inserted into or removed from the first platen support portion 27A. When the chuck 29A is in the open state, the chuck 29A opens as far as a state in which the chuck 29A does not interfere with the second clamped portion 5C of the platen 3 when the first lift 56 rises and lowers. The position at which the shaft 5 of the platen 3A can be inserted into or removed from the first platen support portion 27A is hereinafter referred to as a first predetermined height.

[Print Portion 21]

The print portion 21 will be explained with reference to FIG. 1. The print portion 21 performs the print processing on the shirt 4 on the basis of print data. The print portion 21 is provided with a print head (not shown in the drawings), a carriage (not shown in the drawings), a guide rod (not shown in the drawings), and the like. The print head has a first ejection portion 51 and a second ejection portion 52 (refer to FIG. 4).

The first ejection portion 51 is provided with a plurality of first nozzles (not shown in the drawings) that eject droplets of white ink used to form a background. The second ejection portion 52 is provided with a plurality of second nozzles (not shown in the drawings) that eject droplets of color inks. The second ejection portion 52 that ejects the color inks is provided further downstream, in a conveyance direction when performing the print processing on the shirt 4, than the first ejection portion 51 that ejects the white ink. Specifically, the second ejection portion 52 is provided further to the front than the first ejection portion 51. A nozzle surface of the print head faces downward. The print head is mounted on the carriage and the carriage is guided along the guide rod in a main scanning direction (the left-right direction). The guide rod extends in the left-right direction.

The print portion 21 is provided with the platen 3B, the second conveyance path 24, the second platen support portion 27B, and the like. The second conveyance path 24 extends in the first direction, and guides the second platen support portion 27B so as to be able to move in the first direction. The second conveyance path 24 is provided, for example, with a guide rail (not shown in the drawings), a belt (not shown in the drawings), and the like. The belt is an endless belt that is stretched across pulleys (not shown in the drawings). The pulleys are provided at both end portions, in the first direction, of the bottom surface of the second conveyance path 24, and each pulley is rotatably supported. The belt moves the second platen support portion 27B in the first direction along the guide rail due to rotational driving of a second conveyance motor 55 (refer to FIG. 4). The second conveyance motor 55 is a stepping motor, for example.

[Second Platen Support Portion 27B]

The second platen support portion 27B will be explained with reference to FIG. 1, FIG. 2A, FIG. 2B, and FIG. 2C. The second platen support portion 27B supports the platen 3B, the second platen support portion 27B is provided with a hole 28B, a second lift 57, the chuck 29B, and the like. The hole 28B is provided in the top surface of the second platen support portion 27B and extends in the downward direction. The shaft 5 of the platen 3B can be inserted into the hole 28B. The second lift 57 is provided inside the hole 28B. The second lift 57 is an air cylinder, for example. The top end portion of the second lift 57 is inserted into the recessed portion 5A of the shaft 5 of the platen 3B, and the platen 3B is supported such that the platen 3B can be raised and lowered (can move up and down).

The chuck 29B is provided in a position at which the chuck 29B can clamp the second clamped portion 5C of the shaft 5 of the platen 3. In this case, the shaft 5 is inserted into the hole 28B in the top surface of the second platen support portion 27B. In other words, in a state in which the shaft 5 is inserted into the hole 28B, the chuck 29B is provided in a position facing the second clamped portion 5C of the platen 3. An opening and closing direction of the chuck 29B is the up-down direction, for example. The chuck 29B is open toward the rearward direction, for example. The chuck 29B clamps the second clamped portion 5C of the platen 3 at least during a period in which the second platen support portion 27B is being moved in the first direction. When the chuck 29B is in an open state, the shaft 5 of the platen 3B can be raised or lowered by the second lift 57. The second lift 57 raises the shaft 5 of the platen 3B as far as a position at which the shaft 5 can be inserted into or removed from the second platen support portion 27B. When the chuck 29B is in the open state, the chuck 29B opens as far as a state in which the chuck 29B does not interfere with the second clamped portion 5C of the platen 3 when the second lift 57 rises and lowers. The position at which the shaft 5 of the platen 3B can be inserted into or removed from the second platen support portion 27B is hereinafter referred to as a second predetermined height. The second predetermined height is the same as the first predetermined height.

As shown in FIG. 1, the operation panel 25, and the reservoir portion 26 are provided to the front side of the print device 1, namely, on the side of a setting position to be described later. The reservoir portion 26 houses a plurality of ink cartridges in which the inks of various colors are stored. The color inks stored in the ink cartridges are supplied to the second ejection portion 52 (refer to FIG. 4) via tubes (not shown in the drawings). The white ink stored in the ink cartridges is supplied to the first ejection portion 51 (refer to FIG. 4) via tubes.

Figure 3A:
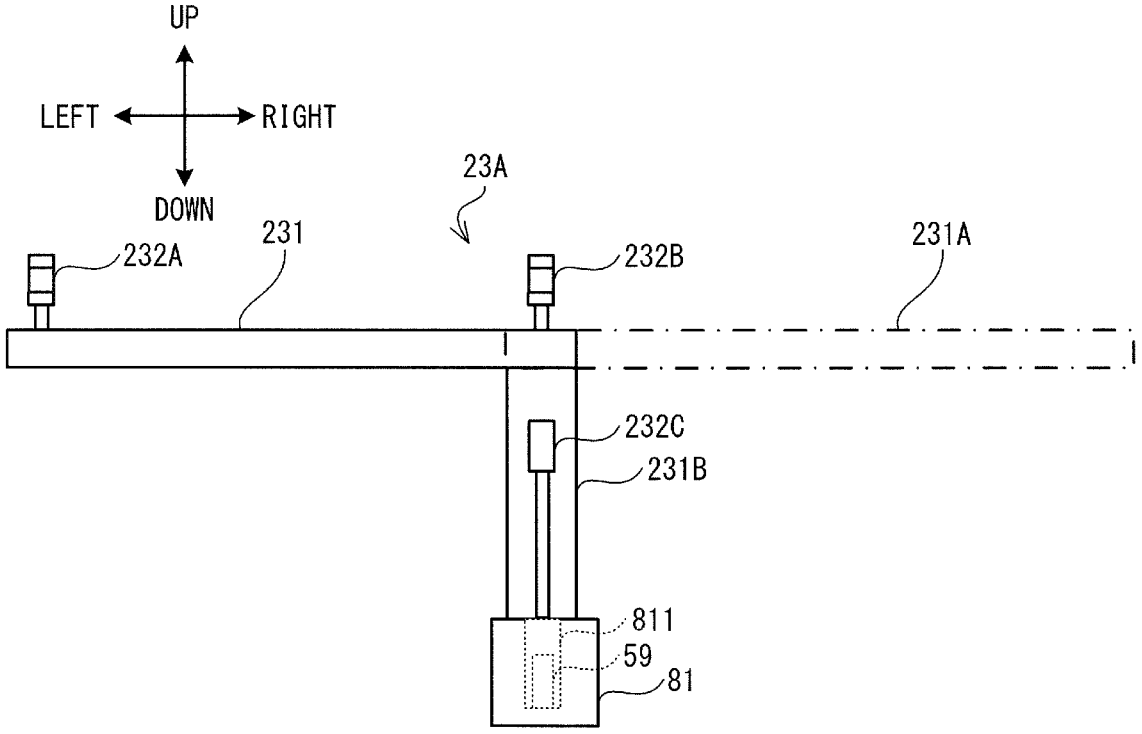
FIG. 3A is a schematic view of a first platen moving portion 23A as seen from the front.

[First platen moving portion 23A and second platen moving portion 23B] The first platen moving portion 23A will be explained with reference to FIG. 1 and FIG. 3A. The first platen moving portion 23A is provided with a first arm 231, a support portion 231B, a first stand-by base 81, and the like. The first arm 231 is a substantially rectangular plate-shaped member that is long in the left-right direction. As shown in FIG. 1, the first arm 231 is positioned further to the rear than the rear ends of the first conveyance path 22 and the second conveyance path 24. The support portion 231B is provided below the first arm 231 and supports the first arm 231 such that the first arm 231 can slide in the left-right direction. The first arm 231 slides in the left-right direction due to driving of a first arm motor 58 (refer to FIG. 4). A rectangle 231A indicated by a one-dot chain line in FIG. 3A shows a case in which the first arm 231 has slid in the rightward direction.

The first arm 231 is provided with a first chuck 232A, a second chuck 232B, and the like. The first chuck 232A is provided on the top surface of the left end portion of the first arm 231. When the first arm 231 has slid to the side of the first conveyance path 22 (the left side), the first chuck 232A moves to a position at which the first chuck 232A can clamp the first clamped portion 5B of the platen 3A which is supported by the first platen support portion 27A positioned in a first predetermined position. The first predetermined position is a position reached by the first platen support portion 27A at the rear end of the first conveyance path 22, namely, is a position 72 shown in FIG. 1. Specifically, the first chuck 232A moves to a position facing the first clamped portion 5B of the platen 3A. Further, when the first arm 231 has slid to the side of the second conveyance path 24 (the right side), the first chuck 232A moves to a position at which the shaft 5 of the platen 3C that is being clamped can be inserted into a hole 811 (to be described later) of the first stand-by base 81.

The second chuck 232B is provided on the top surface of the right end portion of the first arm 231. When the first arm 231 has slid to the side of the second conveyance path 24 (the right side), the second chuck 232B moves to a position at which the shaft 5 of the platen 3C that is being clamped can be inserted into the hole 28B of the second platen support portion 27B positioned in a second predetermined position. The second predetermined position is a position of the rear end of the second conveyance path 24, namely, is a position 74 shown in FIG. 1. Further, when the first arm 231 has slid to the side of the first conveyance path 22 (the left side), the second chuck 232B moves to a position at which the second chuck 232B can clamp the first clamped portion 5B of the platen 3C that is standing by at the first stand-by base 81. Specifically, the second chuck 232B moves to a position facing the first clamped portion 5B of the platen 3C.

The first stand-by base 81 can cause the platen 3C to stand by. The first stand-by base 81 is provided with the hole 811, a third lift 59, a third chuck 232C, and the like. The hole 811 is provided in the top surface of the first stand-by base 81. A center of the hole 811 is position on a straight line connecting a center of the hole 28A of the first platen support portion 27A positioned in the first predetermined position and a center of the hole 28B of the second platen support portion 27B positioned in the second predetermined position. Thus, the first chuck 232A can insert the shaft 5 of the platen 3C that was being clamped in the first predetermined position into the hole 811 of the first stand-by base 81. Further, the second chuck 232B can clamp the first clamped portion 5B of the platen 3C standing by at the first stand-by base 81.

The third lift 59 is provided inside the hole 811. The third lift 59 is an air cylinder, for example. The top end portion of the third lift 59 is inserted into the recessed portion 5A of the shaft 5 of the platen 3C and the platen 3C is supported such that the platen 3C can be raised and lowered (can move up and down). The third chuck 232C is provided in a position at which the third chuck 232C can clamp the second clamped portion 5C of the platen 3C whose shaft 5 is inserted into the hole 811 of the first stand-by base 81. Specifically, in the state in which the shaft 5 is inserted into the hole 811, the third chuck 232C is provided in a position facing the second clamped portion 5C of the platen 3C. An opening and closing direction of the third chuck 232C is the up-down direction, for example. The third chuck 232C is open toward the rearward direction, for example. The shaft 5 of the platen 3C can be raised and lowered by the third lift 59 when the third chuck 232C is in an open state. When the third lift 59 rises to the first predetermined height, the shaft 5 of the platen 3C can be inserted into or removed from the hole 811 of the first stand-by base 81. When the third chuck 232C is in the open state, the third chuck 232C opens as far as a state in which the third chuck 232C does not interfere with the second clamped portion 5C of the platen 3C when the third lift 59 rises and lowers.

Figure 3B:
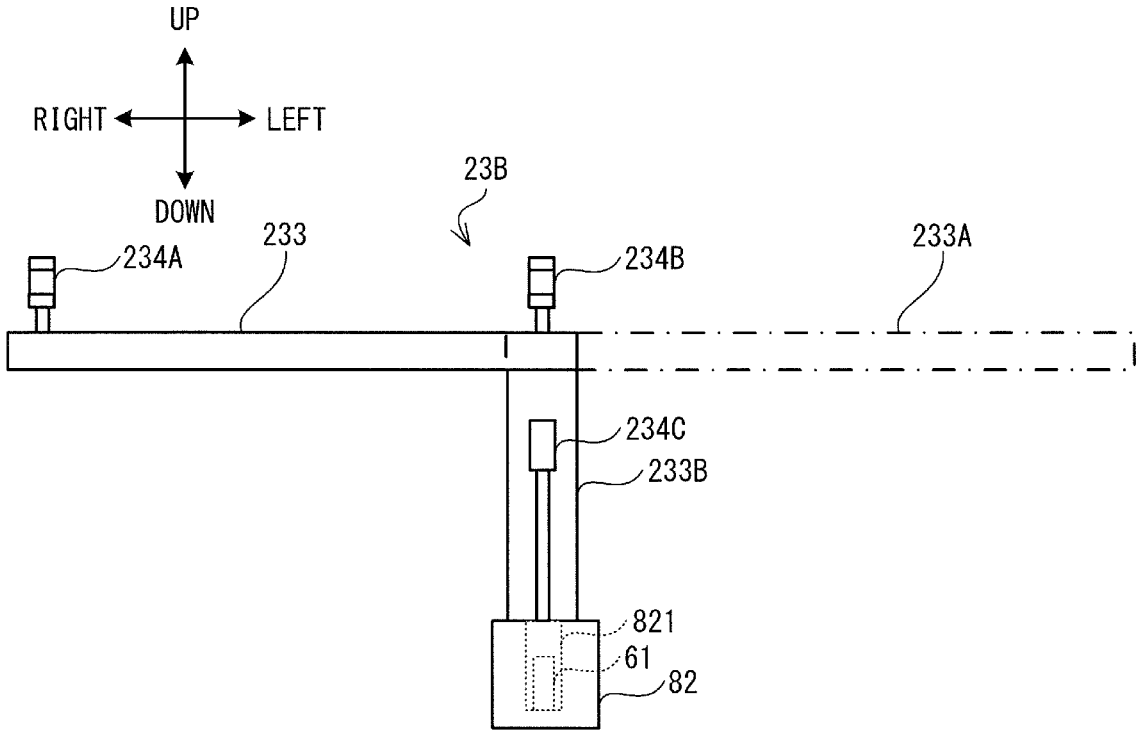
FIG. 3B is a schematic view of a second platen moving portion 23B as seen from the rear.

The second platen moving portion 23B will be explained with reference to FIG. 1 and FIG. 3B. The second platen moving portion 23B is provided with a second arm 233, a support portion 233B, a second stand-by base 82, and the like. The second arm 233 is a substantially rectangular plate-shaped member that is long in the left-right direction. As shown in FIG. 1, the second arm 233 is positioned further to the front than the front ends of the first conveyance path 22 and the second conveyance path 24. The support portion 233B is provided below the second arm 233, and supports the second arm 233 such that the second arm 233 can slide in the left-right direction. The second arm 233 slides in the left-right direction due to driving of a second arm motor 60 (refer to FIG. 4). A rectangle 233A indicated by a one-dot chain line in FIG. 3B shows a case in which the second arm 233 has slid in the leftward direction.

The second arm 233 is provided with a first chuck 234A, a second chuck 234B, and the like. The first chuck 234A is provided on a top surface of the right end portion of the second arm 233. When the second arm 233 has slid to the side of the second conveyance path 24 (the right side), the first chuck 234A moves to a position at which the first chuck 234A can clamp the second clamped portion 5C of the platen 3B which is supported by the second platen support portion 27B positioned in a third predetermined position. The third predetermined position is a position at the front end of the second conveyance path 24, namely a position 75 shown in FIG. 1. Specifically, the first chuck 234A moves to a position facing the second clamped portion 5C of the platen 3B. Further, when the second arm 233 has slid to the side of the first conveyance path 22 (the left side), the first chuck 234A moves to a position at which the shaft 5 of the platen 3C that is being clamped can be inserted into a hole 821 (to be described later) of the second stand-by base 82.

The second chuck 234B is provided on the top surface of the left end portion of the second arm 233. When the second arm 233 has slid to the side of the first conveyance path 22 (the left side), the second chuck 234B moves to a position at which the shaft 5 of the platen 3C that is being clamped can be inserted into the hole 28A of the first platen support portion 27A positioned at the front end of the first conveyance path 22. Further, when the second arm 233 has slid to the side of the second conveyance path 24 (the right side), the second chuck 234B moves to a position at which the second chuck 232B can clamp the second clamped portion 5C of the platen 3C that is standing by at the second stand-by base 82. Specifically, the second chuck 234B moves to a position facing the second clamped portion 5C of the platen 3C.

The second stand-by base 82 can cause the platen 3C to stand by. The second stand-by base 82 is provided with the hole 821, a fourth lift 61, a third chuck 234C, and the like. The hole 821 is provided in the top surface of the second stand-by base 82. A center of the hole 821 is position on a straight line connecting the center of the hole 28A of the first platen support portion 27A positioned at the front end of the first conveyance path 22 and the center of the hole 28B of the second platen support portion 27B positioned in the third predetermined position. Thus, the first chuck 234A can insert the shaft 5 of the platen 3C that was being clamped into the hole 821 of the second stand-by base 82. Further, the second chuck 234B can clamp the second clamped portion 5C of the platen 3C standing by at the second stand-by base 82.

The fourth lift 61 is provided inside the hole 821. The fourth lift 61 is an air cylinder, for example. The top end of the fourth lift 61 is inserted into the recessed portion 5A of the shaft 5 of the platen 3C, and the platen 3C is supported such that the platen 3C can be raised and lowered (can move up and down). The third chuck 234C is provided in a position at which the third chuck 234C can clamp the first clamped portion 5B of the platen 3C whose shaft 5 is inserted into the hole 821 of the second stand-by base 82. Specifically, in the state in which the shaft 5 is inserted into the hole 821, the third chuck 234C is provided in a position facing the first clamped portion 5B of the platen 3C. An opening and closing direction of the third chuck 234C is the up-down direction, for example. The third chuck 234C is open toward the forward direction, for example. The shaft 5 of the platen 3C can be raised and lowered by the fourth lift 61 when the third chuck 234C is in an open state. When the fourth lift 61 rises to the first predetermined height, the shaft 5 of the platen 3C can be inserted into or removed from the hole 821 of the second stand-by base 82. When the third chuck 234C is in the open state, the third chuck 234C opens as far as a state in which the third chuck 234C does not interfere with the first clamped portion 5B of the platen 3C when the fourth lift 61 rises and lowers.

[Setting Position and Removal Position]

The setting position and a removal position will be explained with reference to FIG. 1. The setting position is a position at which the shirt 4 is mounted on the platen 3 with the neckline 4A of the shirt 4 being at the front. The setting position is a position of the platen 3A positioned at the front end of the first conveyance path 22, namely, is a position of the platen 3A positioned in the position 71. Further, the setting position is a position of the platen 3C positioned in the position 75 and the position 76. The operator stands in front of the print device 1, and can mount the shirt 4 on the platen 3C supported by the second platen moving portion 23B. The platens 3C on which the shirts 4 are mounted are sequentially transferred to the first platen support portion 27A by the second platen moving portion 23B.

The removal position is a position at which the shirt 4, which is mounted on the platen 3 with the neckline 4A at the front, is removed. The removal position is a position of the platen 3B positioned at the front end of the second conveyance path 24, namely, is a position of the platen 3B positioned in the position 75. Further, the removal position is a position of the platen 3C positioned in the position 71, and the position 76. The operator is located at the front of the print device 1, and can remove the shirt 4 from the platen 3C supported by the second platen moving portion 23B.

[Electrical Configuration of Print Device 1]

The electrical configuration of the print device 1 will be explained with reference to FIG. 4. The print device 1 is provided with a CPU 11, a ROM 12, a RAM 13, a storage device 14, the separate processing portion 15, the operation panel 25, an input/output portion 18, a communication portion 19, drive circuits 31 to 41, and the like, which are mutually connected via a bus. The CPU 11 controls the print device 1, reads out various programs from the ROM 12, and performs various types of processing. In this case, the CPU 11 uses the RAM 13 as a working memory. The CPU 11 reads out a first main processing program from the ROM 12, for example, and performs first main processing to be described later.

The storage device 14 is a non-volatile memory, such as a flash memory, an HDD, or the like. The storage device 14 stores various parameters and the like. The storage device 14 stores a number of steps of the first conveyance motor 54 when the first platen support portion 27A has reached the first predetermined position. The storage device 14 stores a number of steps of the second conveyance motor 55 when the second platen support portion 27B has reached the third predetermined position. Further, the storage device 14 stores a number of steps of the second conveyance motor 55 when the second platen support portion 27B has reached the third predetermined position. The storage device 14 stores first correspondence information in which the number of steps of the first conveyance motor 54 is associated with a start position of the separate processing at each of Y coordinates of the platen 3A. The storage portion 14 stores second correspondence information in which the number of steps of the second conveyance motor 55 is associated with a start position of the print processing at each of Y coordinates of the platen 3B. Note that Y axes of the platen 3A and the platen 3B are parallel to the first direction. Specifically, the Y axes of the platen 3A and the platen 3B are parallel to a long length direction of the platen 3A and the platen 3B. X axes of the platen 3A and the platen 3B are parallel to the left-right direction. Specifically, the X axes of the platen 3A and the platen 3B are parallel to a short length direction of the platen 3A and the platen 3B.

The operation panel 25 is provided with an operation portion 16, a display portion 17, and the like. The operation portion 16 is provided with buttons and the like, for example. Thus, desired commands of the operator are input to the CPU 11 via the buttons of the operation portion 16. The display portion 17 is configured by a known display device or the like. The display portion 17 may be provided with a touch panel (not shown in the drawings), and may function as the operation portion 16.

The input/output portion 18 is provided with an SD memory card slot, a USB port or a serial port of another standard, and the like. The communication portion 19 has at least one of a wireless module (not shown in the drawings) and a wired module (not shown in the drawings), and can perform mutual communication via a network with an external device, such as a terminal device (not shown in the drawings) or the like. In place of the communication portion 19, the print device 1 may be connected to the external device via the network using a wireless module that can be connected to the USB port.

The print portion 21 is provided with the drive circuits 31 to 33, the first ejection portion 51, the second ejection portion 52, and a carriage motor 53. The drive circuit 31 is connected to the first ejection portion 51, and, under the control of the CPU 11, causes the droplets of the white ink to be ejected from each of the first nozzles (not shown in the drawings) of the first ejection portion 51, for example. The drive circuit 32 is connected to the second ejection portion 52, and, under the control of the CPU 11, causes the color inks to be ejected from each of the second nozzles (not shown in the drawings) of the second ejection portion 52, for example. The drive circuit 33 is connected to the carriage motor 53, and drives the carriage motor 53 under the control of the CPU 11.

The drive circuit 34 is connected to the first conveyance motor 54, and drives the first conveyance motor 54 under the control of the CPU 11. The drive circuit 35 is connected to the second conveyance motor 55, and drives the second conveyance motor 55 under the control of the CPU 11. The drive circuit 36 is connected to the first lift 56, and raises and lowers the first lift 56 under the control of the CPU 11. The drive circuit 37 is connected to the second lift 57, and raises and lowers the second lift 57 under the control of the CPU 11.

The first platen moving portion 23A is provided with the drive circuits 38 and 39, the first arm motor 58, and the third lift 59. The drive circuit 38 is connected to the first arm motor 58, and drives the first arm motor 58 under the control of the CPU 11. The drive circuit 39 is connected to the third lift 59, and raises and lowers the third lift 59 under the control of the CPU 11. The second platen moving portion 23B is provided with the drive circuits 40 and 41, the second arm motor 60, and the fourth lift 61. The drive circuit 40 is connected to the second arm motor 60, and drives the second arm motor 60 under the control of the CPU 11. The drive circuit 41 is connected to the fourth lift 61, and raises and lowers the fourth lift 61 under the control of the CPU 11.

[First Main Processing]

The first main processing will be explained with reference to FIG. 1, and FIG. 5 to FIG. 8. The first main processing is started, for example, when triggered by turning on a power supply of the print device 1. When the power supply of the print device 1 is turned on, the CPU 11 reads out the first main processing program from the ROM 12, and performs the first main processing. In this case, the CPU 11 uses the RAM 13 as the working memory. In the present print device 1, in accordance with the first main processing, the plurality of platens 3 are moved, and processing such as the separate processing is performed on the shirt 4 mounted on each of the platens 3. In the explanation here, the explanation will focus on one of the platens 3. The platen 3 to be focused on is the platen 3A positioned in the position 71 shown in FIG. 1, and the shirt 4 is mounted on the platen 3A such that the neckline 4A is at the front.

The CPU 11 determines whether there is a processing start command (step S1). For example, the processing start command is input to the CPU 11 by the operator operating the operation portion 16 of the operation panel 25. The CPU 11 determines whether there is the processing start command by determining whether the processing start command has been input. When the CPU 11 determines that there is no processing start command (no at step S1), the CPU 11 repeats the processing at step S1. When the CPU 11 determines that there is the processing start command (yes at step S1), the CPU 11 starts conveyance of the platen 3A rearward from the position 71.

The CPU 11 determines whether the platen 3A has reached the start position of the separate processing (step S5). Specifically, the CPU 11 determines whether the platen 3A has reached the start position of the separate processing on the basis of the first correspondence information and the number of steps of the first conveyance motor 54 stored in the storage device 14. When the CPU 11 determines that the platen 3A has not reached the start position of the separate processing (no at step S5), the CPU 11 repeats the processing at step S5. When the CPU 11 determines that the platen 3A has reached the start position of the separate processing (yes at step S5), the CPU 11 controls the separate processing portion 15 and performs the separate processing on the shirt 4 (step S7).

The CPU 11 determines whether the first platen support portion 27A has reached the first predetermined position, namely, whether the platen 3A is positioned in the position 72 shown in FIG. 1 (step S9). Specifically, the CPU 11 refers to the number of steps of the first conveyance motor 54 stored in the storage device 14. The CPU 11 determines whether the first platen support portion 27A has reached the first predetermined position on the basis of the referred to number of steps. The first predetermined position is the position at which the platen 3A is transferred to the first platen moving portion 23A. At this time, the neckline support portion 3D of the platen 3A is positioned at the front of the platen 3A.

When the CPU 11 determines that the first platen support portion 27A has not reached the first predetermined position (no at step S9), the CPU 11 repeats the processing at step S9. When the CPU 11 determines that the first platen support portion 27A has reached the first predetermined position (yes at step S9), the CPU 11 causes the chuck 29A of the first platen support portion 27A to be in the open state with respect to the platen 3A (step S11). The CPU 11 controls the drive circuit 36 and causes the first lift 56 to rise up to the first predetermined height, along with the platen 3A (step S13).

The CPU 11 causes the first chuck 232A of the first platen moving portion 23A to be in the open state, controls the drive circuit 38, and slides the first arm 231 to the side of the first conveyance path 22 (step S15). At this time, when the platen 3C clamped by the second chuck 232B of the first platen moving portion 23A is being transferred to the second platen support portion 27B, the CPU 11 does not cause the first arm 231 to slide. The CPU 11 causes the first arm 231 to slide to the side of the first conveyance path 22 after the platen 3C has been transferred to the second platen support portion 27B. At this time, the CPU 11 causes the first chuck 232A and the second chuck 232B of the first platen moving portion 23A to be in the open state.

There is a case in which the second chuck 232B of the first platen moving portion 23A is clamping the platen 3C, or a case in which another of the platens 3C is standing by at the first stand-by base 81. When the second chuck 232B is clamping the platen 3C, the CPU 11 causes the first arm 231 to slide to the side of the first conveyance path 22 after the platen 3C being clamped by the second chuck 232B, or the platen 3C standing by, has been transferred to the second platen support portion 27B. At this time, the CPU 11 causes the first chuck 232A and the second chuck 232B of the first platen moving portion 23A to be in the open state.

In the position 72 shown in FIG. 1, the CPU 11 causes the first clamped portion 5B of the platen 3A to be clamped by the first chuck 232A of the first platen moving portion 23A (step S17). The CPU 11 controls the drive circuit 36 and lowers the first lift 56 (step S19). The CPU 11 controls the drive circuit 34 and moves the first platen support portion 27A to the front end of the first conveyance path 22, namely, to the position 71 shown in FIG. 1 (step S21).

The CPU 11 determines whether the platen 3C is standing by at the first stand-by base 81 (step S23). When the CPU 11 determines that there is the platen 3C standing by (yes at step S23), the CPU 11 causes the third chuck 232C to be in the open state, controls the drive circuit 39, and raises the third lift 59 to the first predetermined height, along with the platen 3C that is standing by (step S25). The CPU 11 causes the first clamped portion 5B of the platen 3C that is standing by to be clamped by the second chuck 232B (step S27). At this time, since the first arm 231 is caused to slide to the side of the first conveyance path 22, the second chuck 232B is positioned in the position 73 shown in FIG. 1. The CPU 11 controls the drive circuit 39 and lowers the third lift 59 (step S29). The CPU 11 advances the processing to step S51.

When the CPU 11 determines that there is not the platen 3C standing by (no at step S23), the CPU 11 controls the drive circuit 38, and causes the first arm 231 to slide to the side of the second conveyance path 24, along with the platen 3C positioned in the position 72 shown in FIG. 1 (step S31). At this time, the platen 3C that is clamped by the first chuck 232A is positioned in the position 73 shown in FIG. 1. The neckline support portion 3D of the platen 3C is positioned at the front of the platen 3C. The CPU 11 controls the drive circuit 39 and raises the third lift 59 to the first predetermined height (step S33). The CPU 11 opens the first chuck 232A of the first platen moving portion 23A (step S35). The CPU 11 controls the drive circuit 39 and lowers the third lift 59 along with the platen 3C (step S37).

The CPU 11 causes the second clamped portion 5C of the platen 3C to be clamped by the third chuck 232C (step S39). The CPU 11 causes the first chuck 232A and the second chuck 232B of the first platen moving portion 23A to be in the open state, controls the drive circuit 34, and slides the first arm 231 to the side of the first conveyance path 22 (step S41). At this time, the second chuck 232B is positioned in the position 73 shown in FIG. 1. The CPU 11 opens the third chuck 232C (step S43). The CPU 11 controls the drive circuit 39 and raises the third lift 59 to the first predetermined height along with the platen 3C (step S45). The CPU 11 causes the first clamped portion 5B of the platen 3C that is standing by to be clamped by the second chuck 232B of the first platen moving portion 23A (step S47). The CPU 11 controls the drive circuit 39 and lowers the third lift 59 (step S49).

The CPU 11 controls the drive circuit 38 and slides the first arm 231 to the side of the second conveyance path 24, along with the platen 3C (step S51). At this time, the platen 3C clamped by the second chuck 232B is positioned in the position 74 shown in FIG. 1. The neckline support portion 3D of the platen 3C is positioned at the front of the platen 3C. The CPU 11 determines whether the second platen support portion 27B has reached the second predetermined position, namely, the position 74 shown in FIG. 1 (step S53). Specifically, the CPU 11 refers to the number of steps of the second conveyance motor 55 stored in the storage device 14. The CPU 11 determines whether the second platen support portion 27B has reached the second predetermined position on the basis of the referred to number of steps.

When the CPU 11 determines that the second platen support portion 27B has not reached the second predetermined position (no at step S53), the CPU 11 repeats the processing at step S53. When the CPU 11 determines that the second platen support portion 27B has reached the second predetermined position (yes at step S53), the CPU 11 causes the chuck 29B of the second platen support portion 27B to be in the open state, controls the drive circuit 37, and raises the second lift 57 of the second platen support portion 27B to the second predetermined height (step S55). The CPU 11 opens the second chuck 232B (step S57). The CPU 11 controls the drive circuit 37 and lowers the second lift 57 along with the platen 3B (step S59).

The CPU 11 causes the second clamped portion 5C of the platen 3B to be clamped by the chuck 29B of the second platen support portion 27B (step S61). The CPU 11 controls the drive circuit 35 and starts conveyance of the platen 3B (step S63). The CPU 11 determines whether the platen 3B has reached the start position of the print processing (step S65). Specifically, the CPU 11 determines whether the platen 3B has reached the start position of the print processing on the basis of the second correspondence information and the number of steps of the second conveyance motor 55 stored in the storage device 14. When the CPU 11 determines that the platen 3B has not reached the start position of the print processing (no at step S65), the CPU 11 repeats the processing at step S65.

When the CPU 11 determines that the platen 3B has reached the start position of the print processing (yes at step S65), the CPU 11 controls the drive circuits 31 to 33, and the drive circuit 35, and performs the print processing on the shirt 4 mounted on the platen 3B (step S67). The CPU 11 determines whether the second platen support portion 27B has reached the third predetermined position, namely, the position 75 shown in FIG. 1 (step S69). Specifically, the CPU 11 refers to the number of steps of the second conveyance motor 55 stored in the storage device 14. The CPU 11 determines whether the second platen support portion 27B has reached the third predetermined position on the basis of the referred to number of steps.

When the CPU 11 determines that the second platen support portion 27B has not reached the third predetermined position (no at step S69), the CPU 11 repeats the processing at step S69. When the CPU 11 determines that the second platen support portion 27B has reached the third predetermined position (yes at step S69), the CPU 11 causes the chuck 29B of the second platen support portion 27B to be in the open state with respect to the second clamped portion 5C of the platen 3B (step S71). At this time, the neckline support portion 3D of the platen 3B is positioned at the front of the platen 3B. The CPU 11 controls the drive circuit 37 and raises the second lift 57 to the second predetermined height, along with the platen 3B (step S73).

The CPU 11 causes the first chuck 234A and the second chuck 234B of the second platen moving portion 23B to be in the open state, controls the drive circuit 40, and slides the second arm 233 to the side of the second conveyance path 24 (step S75). At this time, when the platen 3C that is clamped by the second chuck 234B of the second platen moving portion 23B is being transferred to the first platen support portion 27A, the CPU 11 does not slide the second arm 233. The CPU 11 slides the second arm 233 to the side of the second conveyance path 24 after the platen 3C has been transferred. At this time, the CPU 11 causes the first chuck 234A and the second chuck 234B of the second platen moving portion 23B to be in the open state.

When the second chuck 234B of the second platen moving portion 23B is clamping the platen 3C, there is a case in which the other platen 3C is standing by at the second stand-by base 82. When the second chuck 234B is clamping the platen 3C, the CPU 11 slides the second arm 233 to the side of the second conveyance path 24 after the platen 3C being clamped by the second chuck 234B has been transferred to the first platen support portion 27A. At this time, the CPU 11 causes the first chuck 234A and the second chuck 234B of the second platen moving portion 23B to be in the open state, and slides the second arm 233.

The CPU 11 causes the second clamped portion 5C of the platen 3B to be clamped by the first chuck 234A of the second platen moving portion 23B, in the position 75 shown in FIG. 1 (step S77). The CPU 11 controls the drive circuit 37 and lowers the second lift 57 (step S79). The CPU 11 controls the drive circuit 35 and moves the second platen support portion 27B to the second predetermined position, namely, to the position 74 shown in FIG. 1 (step S81).

The CPU 11 determines whether the platen 3C is standing by at the second stand-by base 82, in the position 76 shown in FIG. 1 (step S83). When the CPU 11 determines that there is the platen 3C standing by (yes at step S83), the CPU 11 causes the third chuck 234C to be in the open state, controls the drive circuit 41, and raises the fourth lift 61 to the first predetermined height, along with the platen 3C that is standing by (step S85). The CPU 11 causes the second clamped portion 5C of the platen 3C that is standing by to be clamped by the second chuck 234B (step S87). At this time, since the second arm 233 is caused to slide to the side of the second conveyance path 24, the second chuck 234B is positioned in the position 76 shown in FIG. 1. The CPU 11 controls the drive circuit 41 and lowers the fourth lift 61 (step S89). The CPU 11 advances the processing to step S111.

When the CPU 11 determines that there is not the platen 3C standing by (no at step S83), the CPU 11 controls the drive circuit 40 and slides the second arm 233 to the side of the first conveyance path 22, along with the platen 3C (step S91). At this time, the first chuck 234A is positioned in the position 76 shown in FIG. 1. Further, the neckline support portion 3D of the platen 3C is positioned at the front of the platen 3C. The CPU 11 controls the drive circuit 41 and raises the fourth lift 61 to the first predetermined height (step S93). The CPU 11 opens the first chuck 234A of the second platen moving portion 23B (step S95). The CPU 11 controls the drive circuit 41 and lowers the fourth lift 61, along with the platen 3C (step S97).

The CPU 11 causes the first clamped portion 5B of the platen 3C to be clamped by the third chuck 234C, in the position 76 shown in FIG. 1 (step S99). The CPU 11 controls the drive circuit 40 and slides the second arm 233 to the side of the second conveyance path 24 (step S101). At this time, the second chuck 234B is positioned in the position 76 shown in FIG. 1. The CPU 11 opens the third chuck 234C (step S103). The CPU 11 controls the drive circuit 41 and raises the fourth lift 61 to the first predetermined height (step S105). The CPU 11 causes the second clamped portion 5C of the platen 3C that is standing by to be clamped by the second chuck 224B of the second platen moving portion 23B (step S107). The CPU 11 controls the drive circuit 41 and lowers the fourth lift 61 (step S109).

The CPU 11 controls the drive circuit 40 and slides the second arm 233 to the side of the first conveyance path 22, along with the platen 3C that is clamped by the second chuck 234B (step S111). At this time, the second chuck 234B is positioned in the position 71 shown in FIG. 1. Further, the neckline support portion 3D of the platen 3C is positioned at the front of the platen 3C. The CPU 11 determines whether the first platen support portion 27A has reached the front end of the first conveyance path 22 (step S113). When the CPU 11 determines that the first platen support portion 27A has not reached the front end of the first conveyance path 22 (no at step S113), the CPU 11 repeats the processing at step S113. When the CPU 11 determines that the first platen support portion 27A has reached the front end of the first conveyance path 22 (yes at step S113), the CPU 11 causes the chuck 29A of the first platen support portion 27A to be in the open state, controls the drive circuit 36, and raises the first lift 56 of the first platen support portion 27A to the first predetermined height (step S115). The CPU 11 opens the second chuck 234B (step S117). The CPU 11 controls the drive circuit 36 and lowers the first lift 56 (step S119).

The CPU 11 causes the second clamped portion 5C of the platen 3A to be clamped by the chuck 29A of the first platen support portion 27A (step S121). The CPU 11 returns the processing to step S1.

[Main Operations and Effects of First Embodiment]

According to the above-described first embodiment, the print device 1 is provided with the platen 3 that has the neckline support portion 3D that supports the neckline 4A of the shirt 4, the arrow 3E that guides the position of the neckline 4A of the shirt 4, or the marker 3F. The print device 1 is provided with the first platen support portion 27A that supports the platen 3, the first conveyance path 22 that guides the first platen support portion 27A that movably guides the first platen support portion 27A can move in the first direction, and the separate processing portion 15 that is positioned partway along the first conveyance path 22 and that performs the separate processing on the shirt 4. The print device 1 is provided with the second platen support portion 27B that supports the platen 3, the second conveyance path 24 that guides the second platen support portion 27B that movably guides the second platen support portion 27B in the first direction, and the print portion 21 that is positioned partway along the second conveyance path 24 and that performs the print processing on the shirt 4. The print device 1 is provided with the first platen moving portion 23A and the second platen moving portion 23B that move the platen 3, which is supported by one of the first platen support portion 27A and the second platen support portion 27B with the neckline 4A positioned on the front side in the first direction, to the other of the first platen support portion 27A and the second platen support portion 27B with the neckline 4A positioned on the front side in the first direction.

In this way, the print device 1 reduces time and effort to perform the setting and removal of the shirt 4 at each of the separate processing portion 15 and the print portion 21. Further, the setting and removal of the shirt 4 can be performed with the neckline 4A of the shirt 4 being at the front side in the first direction, namely, at the front side of the print device 1.

In the print device 1, the plurality of platens 3 are placed on the first platen moving portion 23A and the second platen moving portion 23B. The first platen moving portion 23A and the second platen moving portion 23B sequentially move the platens 3 between the first platen support portion 27A and the second platen support portion 27B, with the neckline 4A is positioned on the front side in the first direction. In this way, the print device 1 can continuously perform the separate processing without waiting for the print processing to end.

The print device 1 is provided with the first platen moving portion 23A that moves the platen 3A which is supported by the first platen support portion 27A to the second platen support portion 27B, with the neckline 4A being positioned on the front side in the first direction. In this way, the print device 1 can move the platen 3, which is supported in a state in which the neckline 4A of the shirt 4 is on the front side in the first direction, from the first platen support portion 27A to the second platen support portion 27B in the same state.

The print device 1 is provided with the second platen moving portion 23B that moves the platen 3B which is supported by the second platen support portion 27B to the first platen support portion 27A, with the neckline 4A being positioned on the front side in the first direction. In this way, the print device 1 can move the platen 3, which is supported in the state in which the neckline 4A of the shirt 4 is on the front side in the first direction, from the second platen support portion 27B to the first platen support portion 27A in the same state.

At least one of the first platen moving portion 23A and the second platen moving portion 23B moves the platen 3 by sliding horizontally in the left-right direction that is orthogonal to the first direction. If the platen 3 rotates horizontally, a movement trajectory of platen 3 describes an arc, and a larger movement space is required. When the platen 3 moves from the first platen support portion 27A to the second platen support portion 27B, or from the second platen support portion 27B to the first platen support portion 27A, in comparison to a case in which rotation of the platen 3 is necessary, the platen 3 moves by sliding in the left-right direction, and it is thus not necessary to widen the movement space of the platen 3.

The second platen moving portion 23B is positioned further to the front side in the first direction than the print portion 21 and the separate processing portion 15. The setting position of the shirt 4 is positioned at one of the second platen moving portion 23B and the first platen support portion 27A in a case in which the separate processing portion 15 performs the processing first. On the other hand, the setting position of the shirt 4 is positioned at one of the second platen moving portion 23B and the second platen support portion 27B in a case in which the print portion 21 performs the processing first. In this way, the operator can set the shirt 4 at the front side of the print device 1 in the first direction.

The second platen moving portion 23B is positioned further to the front side in the first direction than the print portion 21 and the separate processing portion 15. The removal position of the shirt 4 is positioned at one of the second platen moving portion 23B and the first platen support portion 27A in a case in which the separate processing portion 15 performs the processing lastly. One the other hand, the removal position of the shirt 4 is positioned at one of the second platen moving portion 23B and the second platen support portion 27B in a case in which the print portion 21 performs the processing lastly. In this way, the operator can remove the shirt 4 on the front side of the print device 1 in the first direction.

The print device 1 is provided with the print portion 21 that ejects the inks and prints on the shirt 4. In this way, the print device 1 can perform the print processing on the shirt 4.

The print portion 21 is provided with the first ejection portion 51 that ejects the white ink used to form the background on the shirt 4, and the second ejection portion 52 that ejects the color inks and that is provided further downstream than the first ejection portion 51. The second ejection portion 52 that ejects the color inks is provided further downstream than the first ejection portion 51 that ejects the white ink used to form the background, and thus, the print device 1 can perform the printing without returning the platen 3 from the upstream side to the downstream side.

The reservoir portion 26 is provided further to the front side in the first direction than the separate processing portion 15 and the print portion 21. The reservoir portion 26 stores the inks supplied to the print portion 21. In this way, the operator can perform a storage operation of the inks into the reservoir portion 26 on the same front side as the setting position of the shirt 4.

The print device 1 is provided with the operation portion 16 that receives a single operation from the operator. When the single command is received, the CPU 11 continuously performs the processing of the separate processing portion 15 and the print portion 21. The performing of the processing by the separate processing portion 15 and the performing of the processing by the print portion 21 can be performed by the single operation from the operator, and thus the time and effort of the operator is reduced. Further, there is no need to wait for the operation from the operator, and the productivity of the print device 1 is improved.

The operation portion 16 used to operate the print device 1 is provided further to the front side in the first direction than the separate processing portion 15 and the print portion 21. In this way, the operator can operate the print device 1 on the same front side as the setting position of the shirt 4.

The first platen moving portion 23A moves the first arm 231, and moves the platen 3A which is supported by the first platen support portion 27A to the second platen support portion 27B, with the neckline 4A being positioned on the front side in the first direction. Similarly, the second platen moving portion 23B moves the second arm 233, and moves the platen 3B which is supported by the second platen support portion 27B to the first platen support portion 27A, with the neckline 4A being positioned on the front side in the first direction.

In this way, the first platen moving portion 23A and the second platen moving portion 23B reduce the time and effort to set and remove the shirt 4 at each of the separate processing portion 15 and the print portion 21. Further, the setting and removal of the shirt 4 is possible such that the neckline 4A of the shirt 4 is on the front side in the first direction, namely, on the front side of the print device 1.

The first platen moving portion 23A is provided with the first arm 231 that receives the platen 3 from the first platen support portion 27A, and transfers the received platen 3 to the second platen support portion 27B. The first platen moving portion 23A is provided with the support portion 231B that movably supports the first arm 231. Similarly, the second platen moving portion 23B is provided with the second arm 233 that receives the platen 3 from the second platen support portion 27B and transfers the received platen 3 to the first platen support portion 27A. The second platen moving portion 23B is provided with the support portion 233B that movably supports the second arm 233. Thus, the first arm 231 and the second arm 233 can transfer the platen 3 between the first platen support portion 27A and the second platen support portion 27B.

Second Embodiment

Hereinafter, a second embodiment will be explained. In the first embodiment, the first platen support portion 27A and the second platen support portion 27B are respectively provided with the lifts. In the second embodiment, a point of difference is that the support portion 231B of the first platen moving portion 23A and the support port 233B of the second platen moving portion 23B are respectively provided with the first lift 56 and the second lift 57.

The overall electrical configuration of the print device 1 is the same as in the first embodiment and an explanation of the electrical configuration is omitted here. In the second embodiment, the lift provided in the support portion 231B of the first platen moving portion 23A is the first lift 56, and the lift provided in the support portion 233B of the second platen moving portion 23B is the second lift 57.

[Second Main Processing]

Second main processing will be explained with reference to FIG. 1, and FIG. 9 to FIG. 12. The second main processing is different from the first main processing in that the first lift 56 of the first platen moving portion 23A rises and lowers when the platen 3A moves from the first platen support portion 27A to the first platen moving portion 23A. The second main processing is different from the first main processing in that the first lift 56 of the first platen moving portion 23A rises and lowers when the platen 3C moves from the first platen moving portion 23A to the second platen support portion 27B. The second main processing is different from the first main processing in that the second lift 57 of the second platen moving portion 23B rises and lowers when the platen 3B moves from the second platen support portion 27B to the second platen moving portion 23B. The second main processing is different from the first main processing in that the second lift 57 of the second platen moving portion 23B rises and lowers when the platen 3C moves from the second platen moving portion 23B to the first platen support portion 27A.

In the present print device 1, in accordance with the second main processing, the plurality of platens 3 are moved and the processing, such as the separate processing, is performed on the shirt 4 mounted on each of the platens 3. In the explanation here, the explanation will focus on one of the platens 3. The platen 3 to be focused on is the platen 3A positioned in the position 71, and the shirt 4 is mounted on the platen 3A such that the neckline 4A is at the front. Processing that is the same as that of the first main processing will be assigned the same reference numeral, and an explanation of the processing assigned with the same reference numeral will be omitted.

The second main processing is started, for example, when triggered by turning on the power supply of the print device 1. When the power supply is turned on, the CPU 11 reads out a second main processing program from the ROM 12, and performs the second main processing. The CPU 11 uses the RAM 13 as the working memory. The CPU 11 performs the processing from step S1 to step S11 in a similar manner to the first main processing. After performing the processing from step S1 to step S11, the CPU 11 performs the processing at step S15 and step S17 in a similar manner to the first main processing. After performing the processing at step S15 and step S17, the CPU 11 controls the drive circuit 36 and raises the first lift 56 of the first platen moving portion 23A to the first predetermined height, along with the platen 3A (step S18). At this time, the first chuck 232A of the first arm 231 clamps the platen 3C and is positioned in the position 72 shown in FIG. 1. After performing the processing at step S18, the CPU 11 performs the processing at step S21 to step S53 in a similar manner to the first main processing.

When the second platen support portion 27B is in the second predetermined position (yes at step S53), the CPU 11 controls the drive circuit 36 and lowers the first lift 56 of the first platen moving portion 23A, along with the platen 3C (step S54). At this time, the second chuck 232B of the first arm 231 clamps the platen 3C and is positioned in the position 74 shown in FIG. 1. After performing the processing at step S54, the CPU 11 performs the processing at step S57 in a similar manner to the first main processing. After performing the processing at step S57, the CPU 11 performs the processing at step S61 to step S77 in a similar manner to the first main processing, excepting the processing at step S73 of the first main processing.

After performing the processing at step S61 to step S77, excepting the processing at step S73, the CPU 11 raises the second lift 57 of the second platen moving portion 23B to the second predetermined height, along with the platen 3B (step S78). At this time, the first chuck 234A of the second arm 233 is positioned in the position 75 shown in FIG. 1. After performing the processing at step S78, the CPU 11 performs the processing at step S81 to step S113 in a similar manner to the first main processing.

When the first platen support portion 27A is positioned at the front end of the first conveyance path 22 (yes at step S113), the CPU 11 controls the drive circuit 37 and lowers the second lift 57 of the second platen moving portion 23B (step S114). At this time, the second chuck 234B of the second arm 233 clamps the platen 3C and is positioned in the position 71 shown in FIG. 1. After performing the processing at step S114, the CPU 11 performs the processing at step S117 in a similar manner to the first main processing. After performing the processing at step S117, the CPU 11 performs the processing at step S121 in a similar manner to the first main processing. The CPU 11 returns the processing to step S1.

[Main Operations and Effects of Second Embodiment]

According to the above-described second embodiment, the same effects are achieved as those of the above-described first embodiment.

Modified Examples

The present disclosure is not limited to the above-described embodiments and various modifications are possible. The steps of the first main processing and the second main processing may be re-arranged insofar as no contradictions arise. The ink used to form the background may be an ink other than the white ink. For example, the ink used to form the background may be a functional ink, such as a discharge agent or the like. When the ink used to form the background is the discharge agent, the color inks may include the white ink. The opening and closing direction of each of the chucks need not necessarily be the up-down direction, and may be the horizontal direction, for example. The arrow 3E may be provided in any position on the top surface of the platen 3. The platen 3 may be provided with a plurality of any of the neckline support portion 3D, the arrow 3E and the marker 3F. The marker 3F may be any shape. A configuration may be adopted in which only one of the platens 3C can be placed on at least one of the first platen moving portion 23A and the second platen moving portion 23B.

The print portion 21 may be a laser printer. In this case, the reservoir portion 26 houses a plurality of tanks storing toners of each of colors. The reservoir portion 26 may store functional inks that are supplied to the print portion 21 or to the separate processing portion 15. The functional ink that is supplied to the print portion 21 is the discharge agent that removes color from the shirt 4, for example. The functional ink that is supplied to the separate processing portion 15 is the pretreatment agent, for example.

The CPU 11 may transfer the platen 3C received from the first platen support portion 27A to the second platen support portion 27B by causing the first arm 231 to rotate to the rear in the horizontal direction around the support portion 231B. At this time, during the rotation of the first arm 231, the CPU 11 rotates the platen 3C transferred from the first platen support portion 27A by 180 degrees in the horizontal direction. In this case, the support portion 231B rotatably supports the first arm 231. Similarly, the CPU 11 may transfer the platen 3C received from the second platen support portion 27B to the first platen support portion 27A by causing the second arm 233 to rotate to the front in the horizontal direction around the support portion 233B. At this time, during the rotation of the second arm 233, the CPU 11 rotates the platen 3C transferred from the second platen support portion 27B by 180 degrees in the horizontal direction. In this case, the support portion 233B rotatably supports the second arm 233.

The first ejection portion 51 may eject the droplets of the color inks. In this case, it is sufficient that the second ejection portion 52 eject the white ink used to form the background. The shirt 4 is mounted on the platen 3 such that the neckline 4A is at the front, but the shirt 4 may be mounted such that the neckline 4A is at the rear, or the shirt 4 may be mounted with another orientation.

In the above-described first embodiment and second embodiment, at least one of the first platen moving portion 23A and the second platen moving portion 23B may move the platen 3 by horizontally sliding in the direction (the left-right direction) that is orthogonal to the first direction, and also sliding in the first direction. For example, when the first conveyance path 22 and the second conveyance path 24 are short, it is difficult for the first platen support portion 27A and the second platen support portion 27B to reach the path of the first platen moving portion 23A or the second platen moving portion 23B. Thus, it is difficult for the print device 1 to move the platen 3. In this case, the print device 1 can move the platen 3 as a result of the first platen moving portion 23A and the second platen moving portion 23B sliding in the first direction.

Figure 13A:
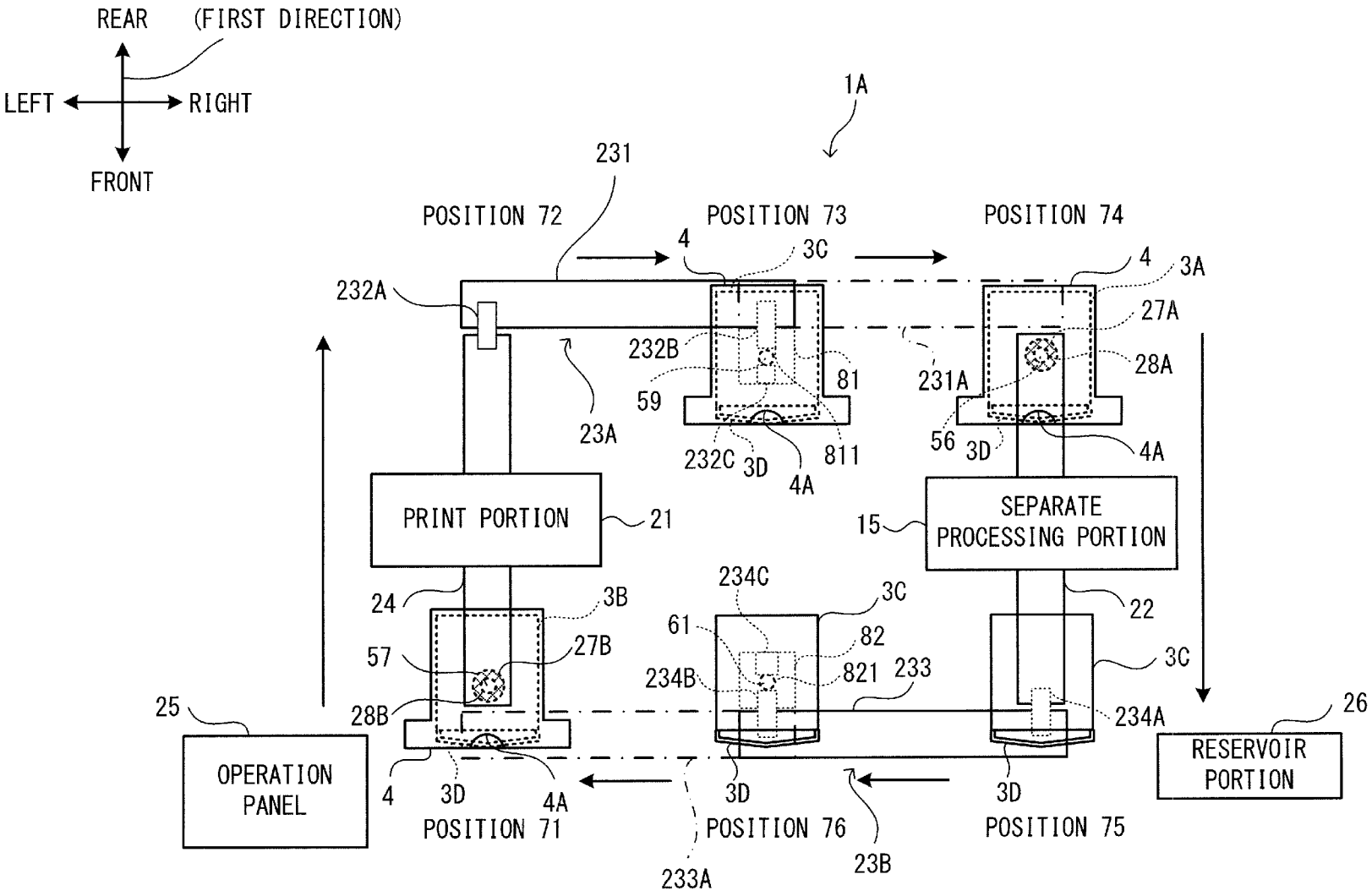
FIG. 13A is diagrams of a print device 1A showing another configuration example of the print device 1.
Figure 13B:
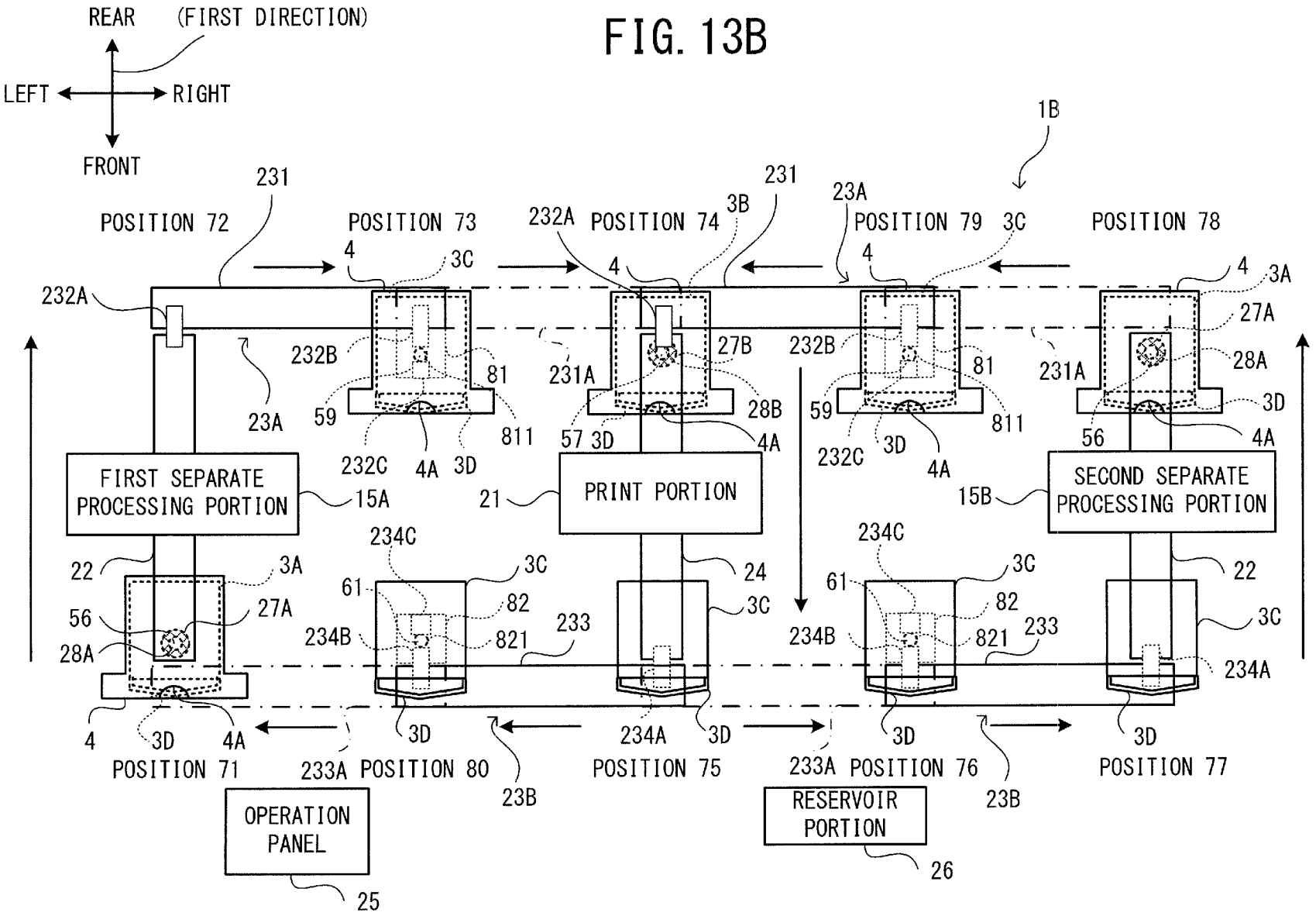
FIG. 13B is diagrams of a print device 1B showing another configuration example of the print device 1.

A print device 1A that is a modified example of the print device 1 will be explained with reference to FIG. 13A. The print device 1A performs the separate processing using the separate processing portion 15 after performing the print processing on the shirt 4 using the print portion 21. The print device 1A may be provided with another of the print portions 21 that performs the print processing on the shirt 4 after the separate processing by the separate processing portion 15. A print device 1B that is a modified example of the print device 1 will be explained with reference to FIG. 13B. The print device 1B has a configuration in which the single print portion 21 is shared between a first separate processing portion 15A and a second separate processing portion 15B. When the separate processing by the first separate processing portion 15A and the second separate processing portion 15B takes a longer amount of time than the print processing by the print portion 21, the productivity of the print device 1B improves. Further, the print device 1B may perform, on the shirt 4, first separate processing using the first separate processing portion 15A, the print processing using the print portion 21, and second separate processing using the second separate processing portion 15B, in order. The print device 1B may be provided with three or more of the separate processing portions 15.

Figure 14A:
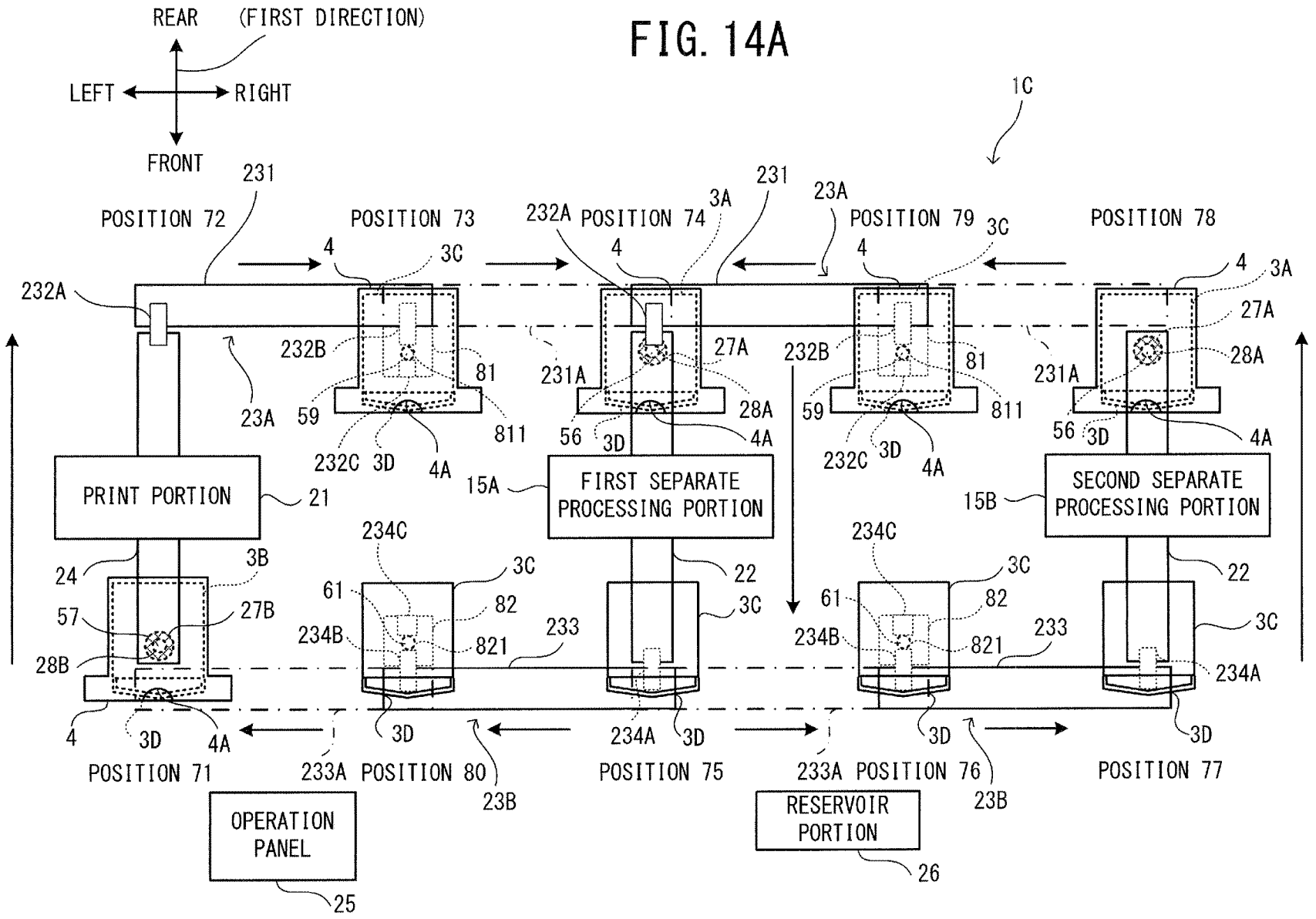
FIG. 14A is diagrams of a print device 1C showing another configuration example of the print device 1.
Figure 14B:
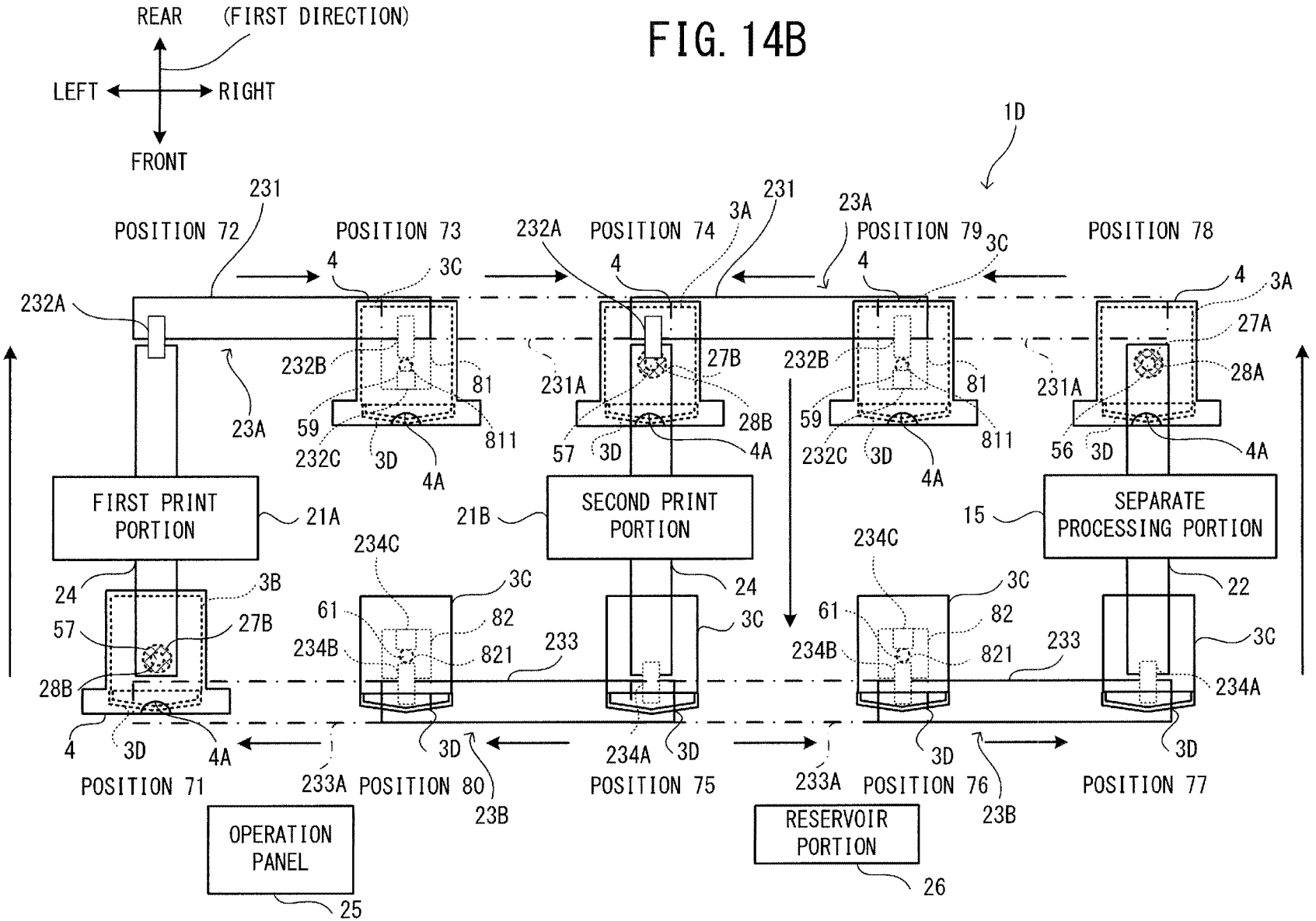
FIG. 14B is diagrams of a print device 1D showing another configuration example of the print device 1.

A print device 1C that is a modified example of the print device 1 will be explained with reference to FIG. 14A. The print device 1C performs, on the shirt 4, the print processing using the print portion 21, the first separate processing using the first separate processing portion 15A, and the second separate processing using the second separate processing portion 15B, in order. The print device 1C may be provided with three or more of the separate processing portions 15. A print device 1D that is a modified example of the print device 1 will be explained with reference to FIG. 14B. The print device 1D performs, on the shirt 4, first print processing using a first print portion 21A, second print processing using a second print portion 21B, and the separate processing using the separate processing portion 15, in order. The print device 1D may be further provided with one or more of the other separate processing portions 15 that perform the separate processing on the shirt 4 after the separate processing by the separate processing portion 15.

The programs used to execute the first main processing, the second main processing, and the like may be stored in a disk device included in a server device on the Internet, and various programs may be downloaded to the print device 1.

In accordance with the embodiments or the modified examples, the print device 1 may use another type of storage device other than the ROM and the RAM. For example, the print device 1 may include a storage device such as a CAM, an SRAM, an SDRAM or the like.

Figure 4:
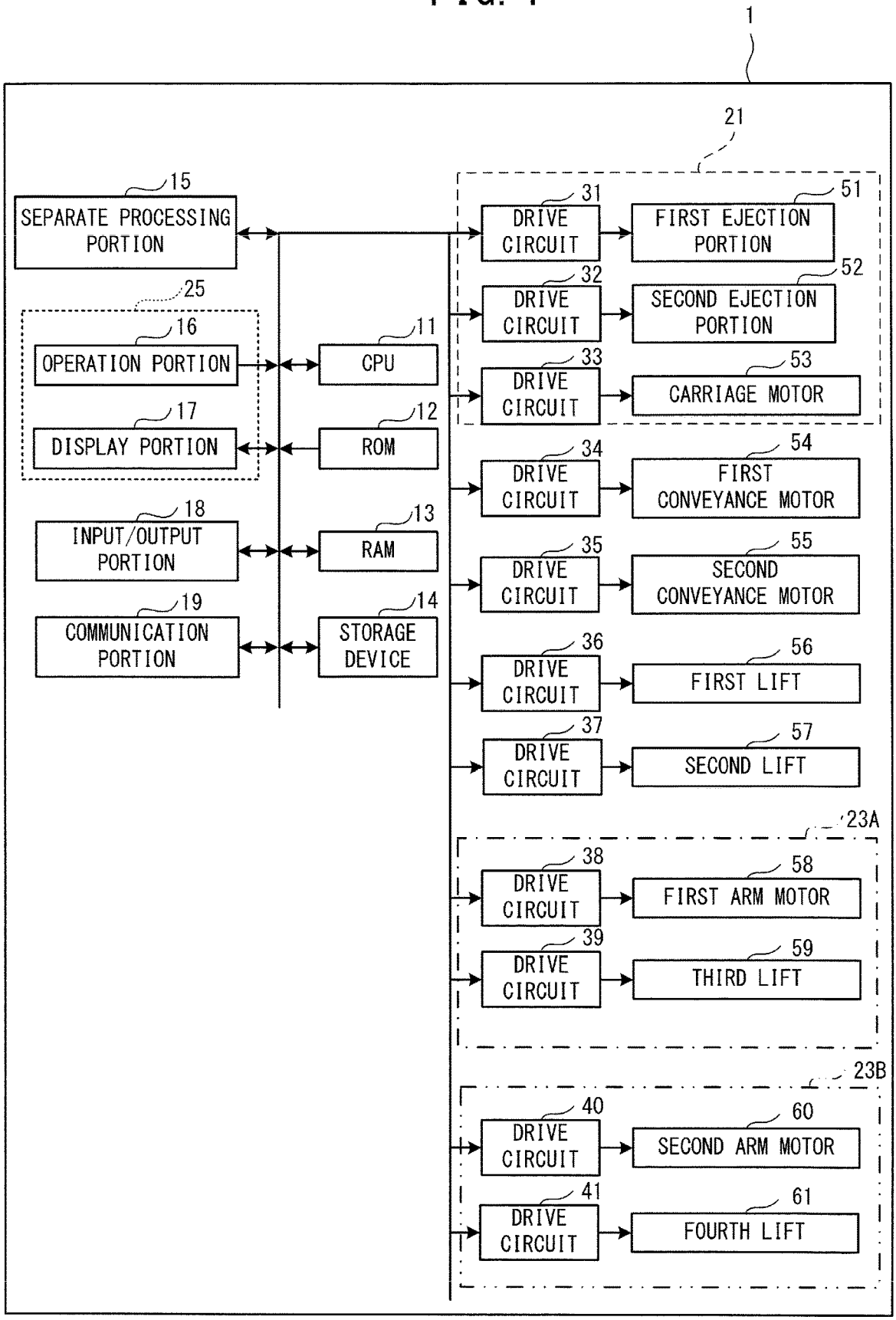
FIG. 4 is a block diagram showing a schematic electrical configuration of the print device 1.
Figure 5:
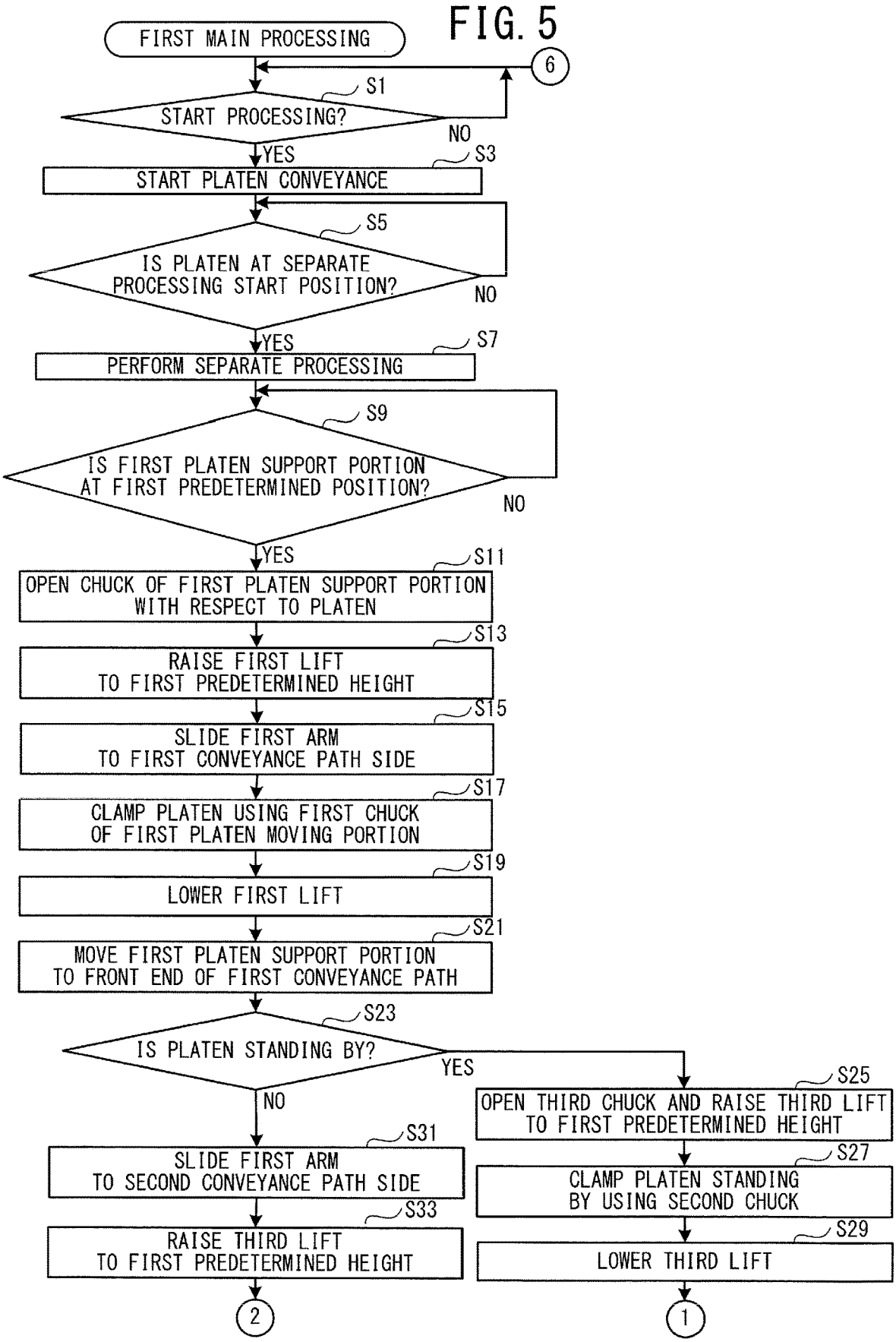
FIG. 5 is a first section of a flowchart of first main processing.
Figure 6:
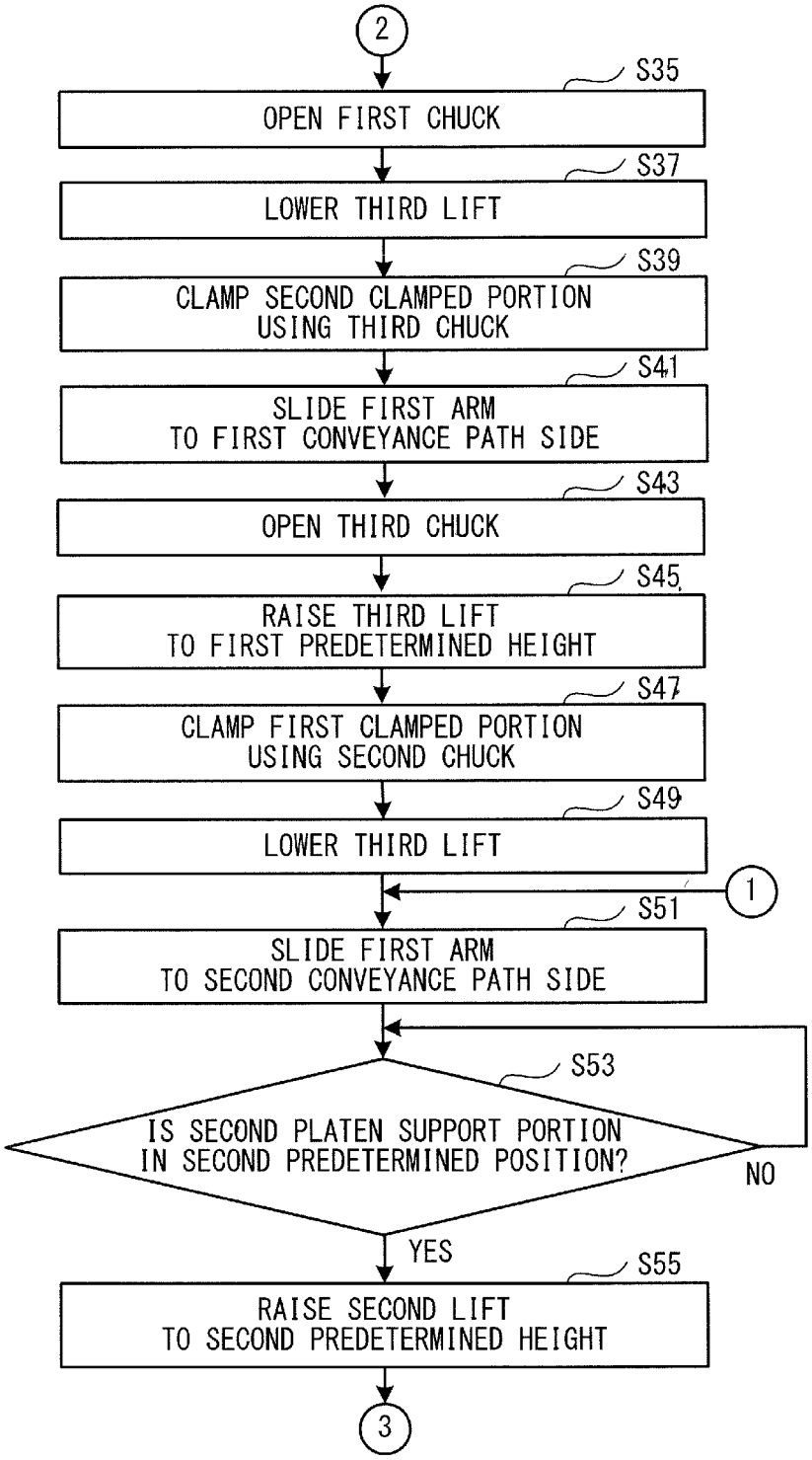
FIG. 6 is a second section of the flowchart of the first main processing.
Figure 7:
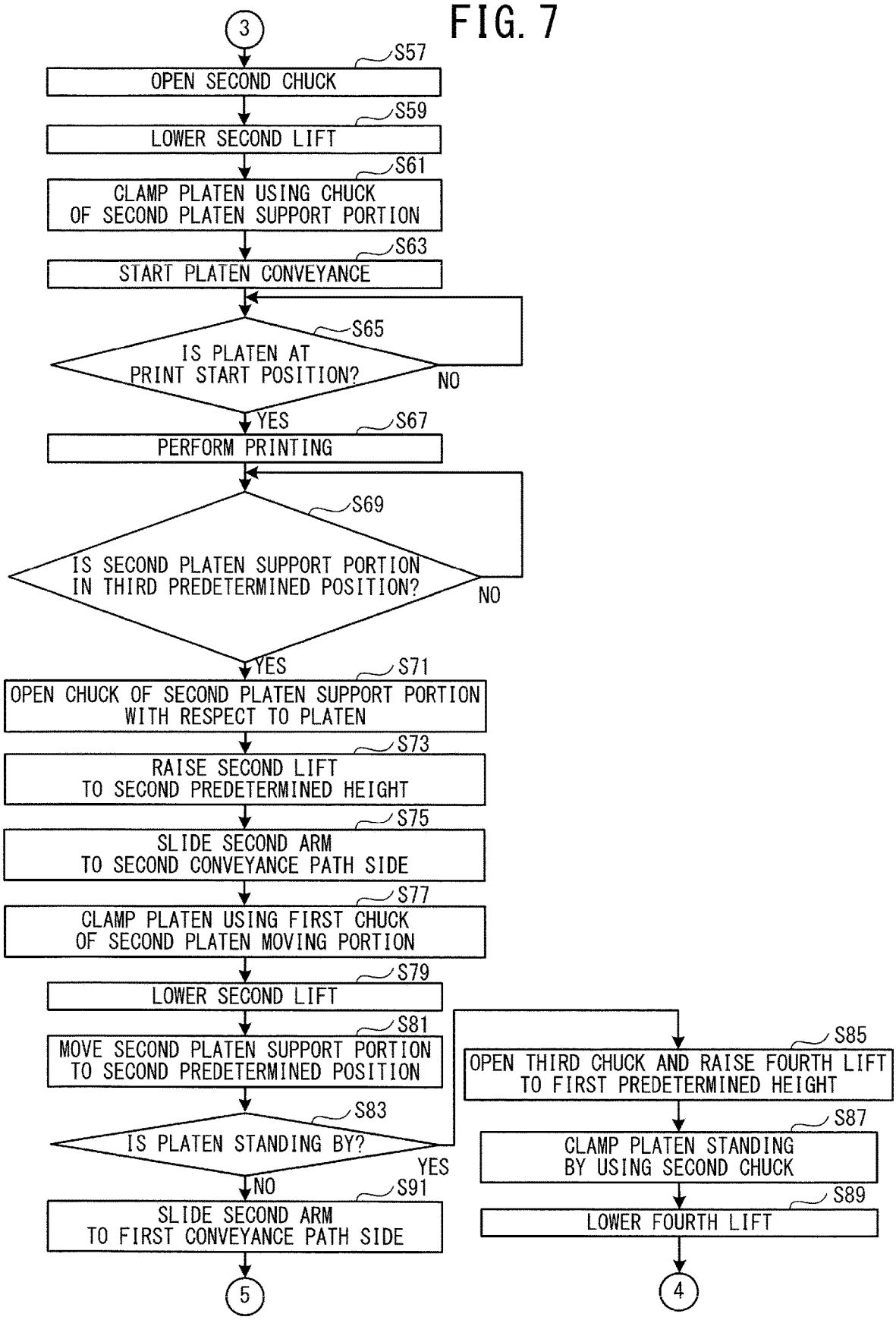
FIG. 7 is a third section of the flowchart of the first main processing.
Figure 8:
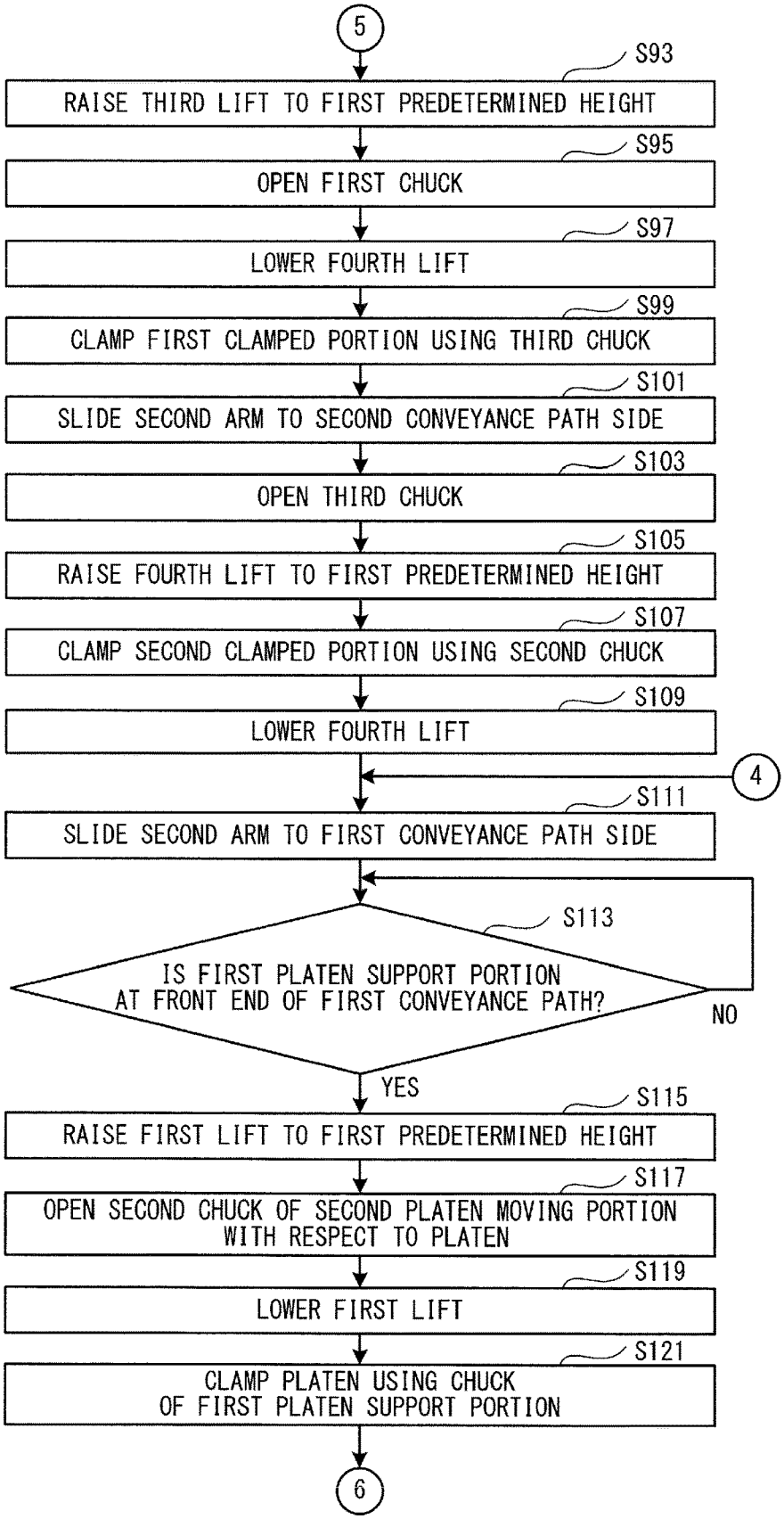
FIG. 8 is a fourth section of the flowchart of the first main processing.
Figure 9:
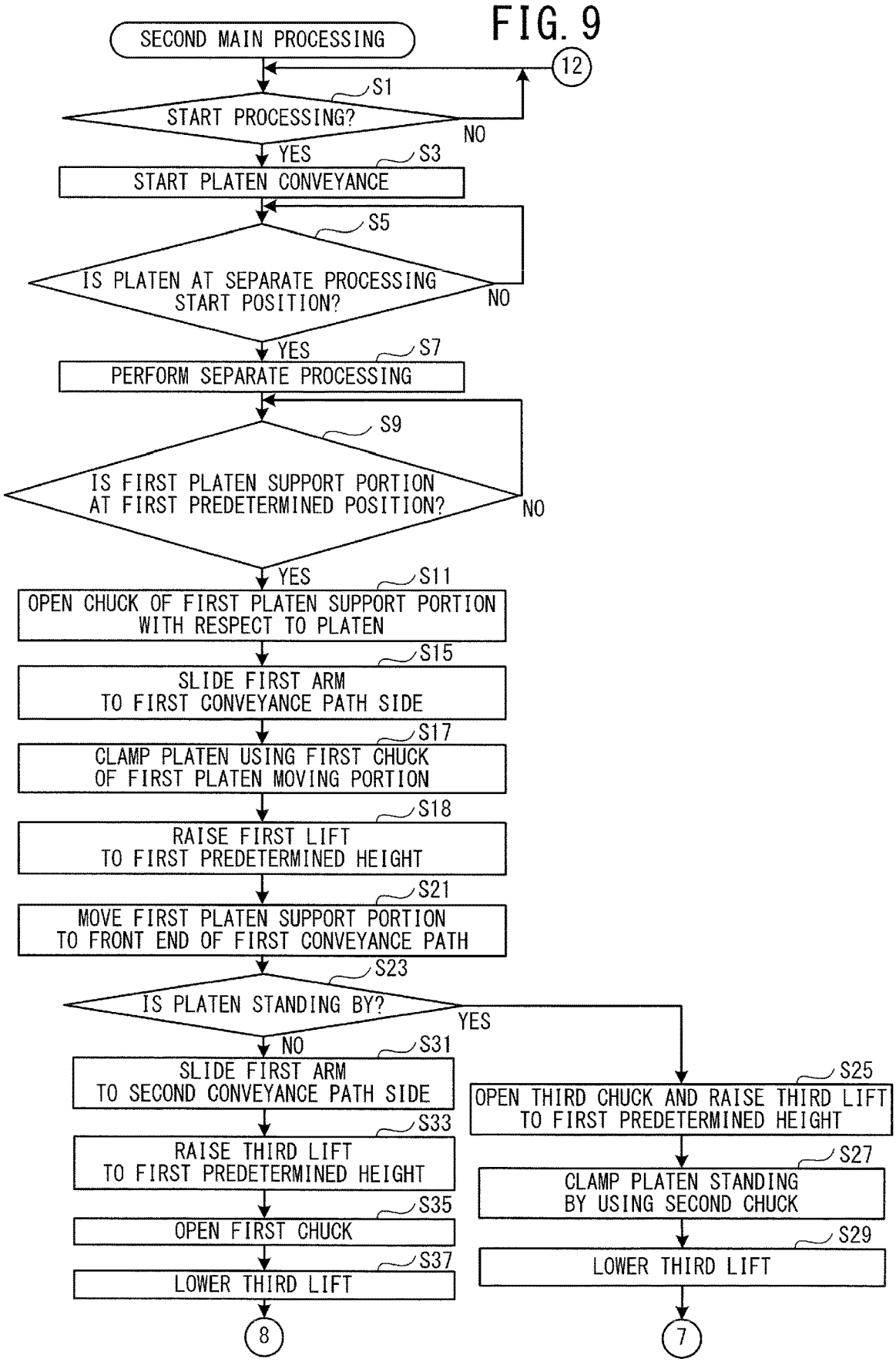
FIG. 9 is a first section of a flowchart of second main processing.
Figure 10:
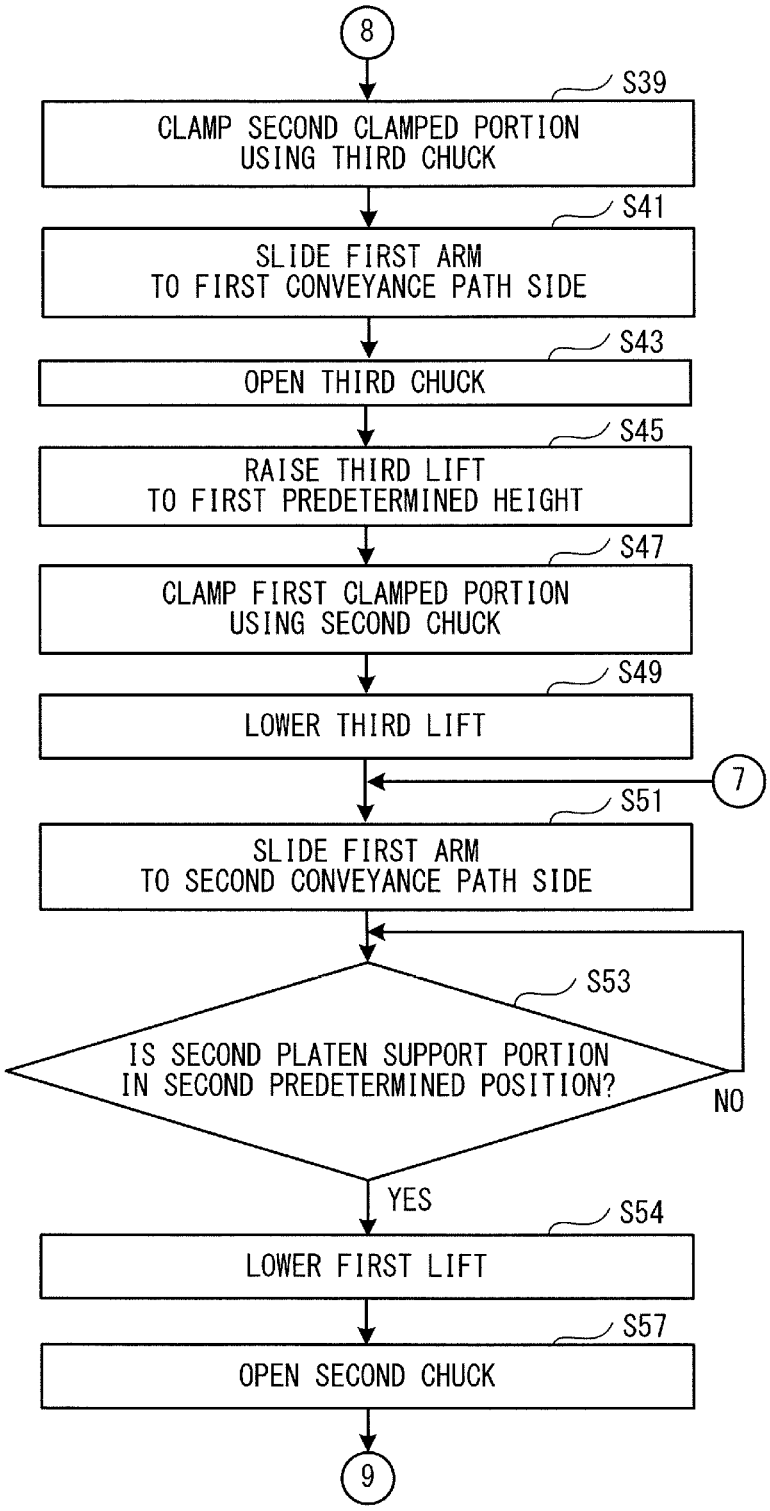
FIG. 10 is a second section of the flowchart of the second main processing.
Figure 11:
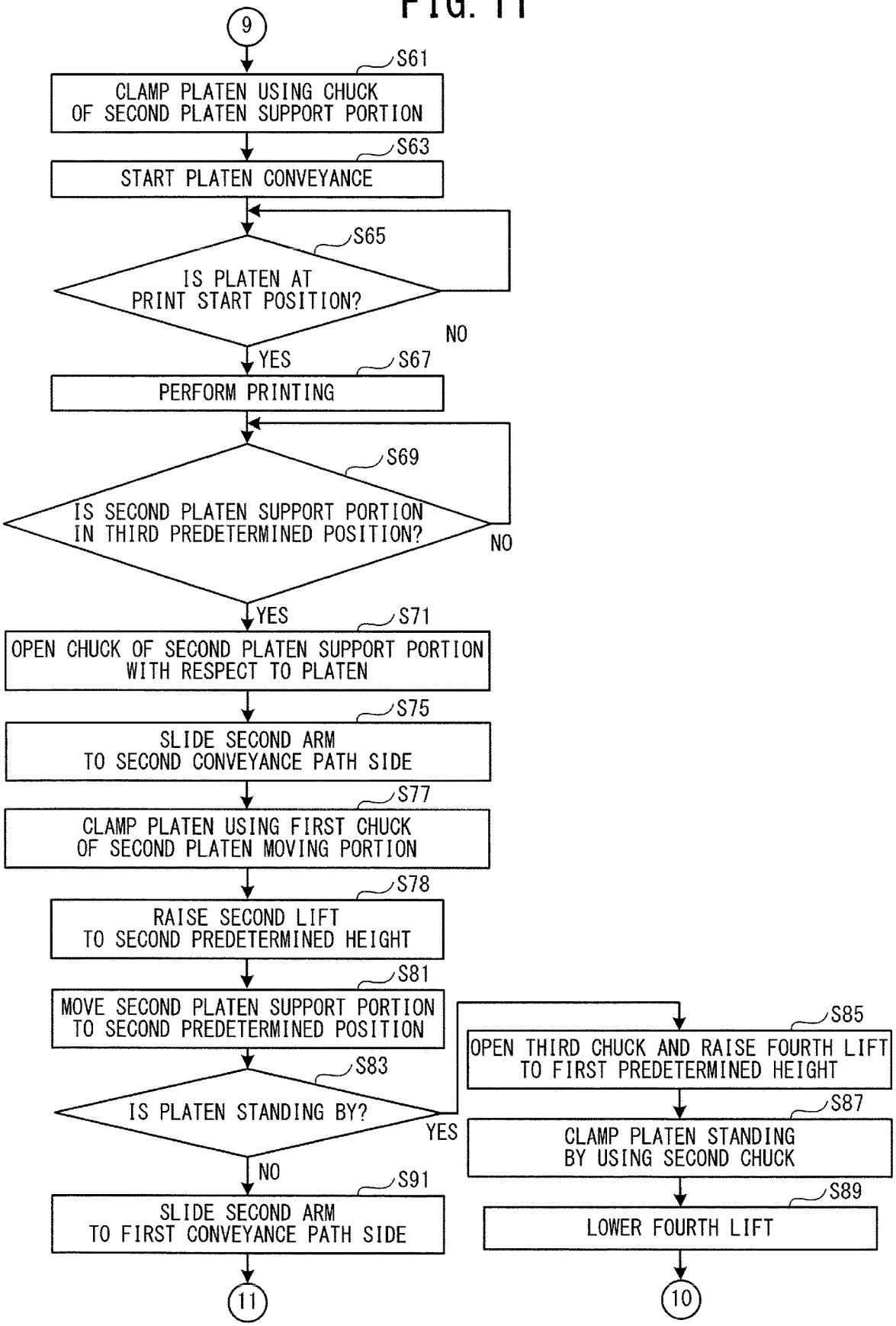
FIG. 11 is a third section of the flowchart of the second main processing.
Figure 12:
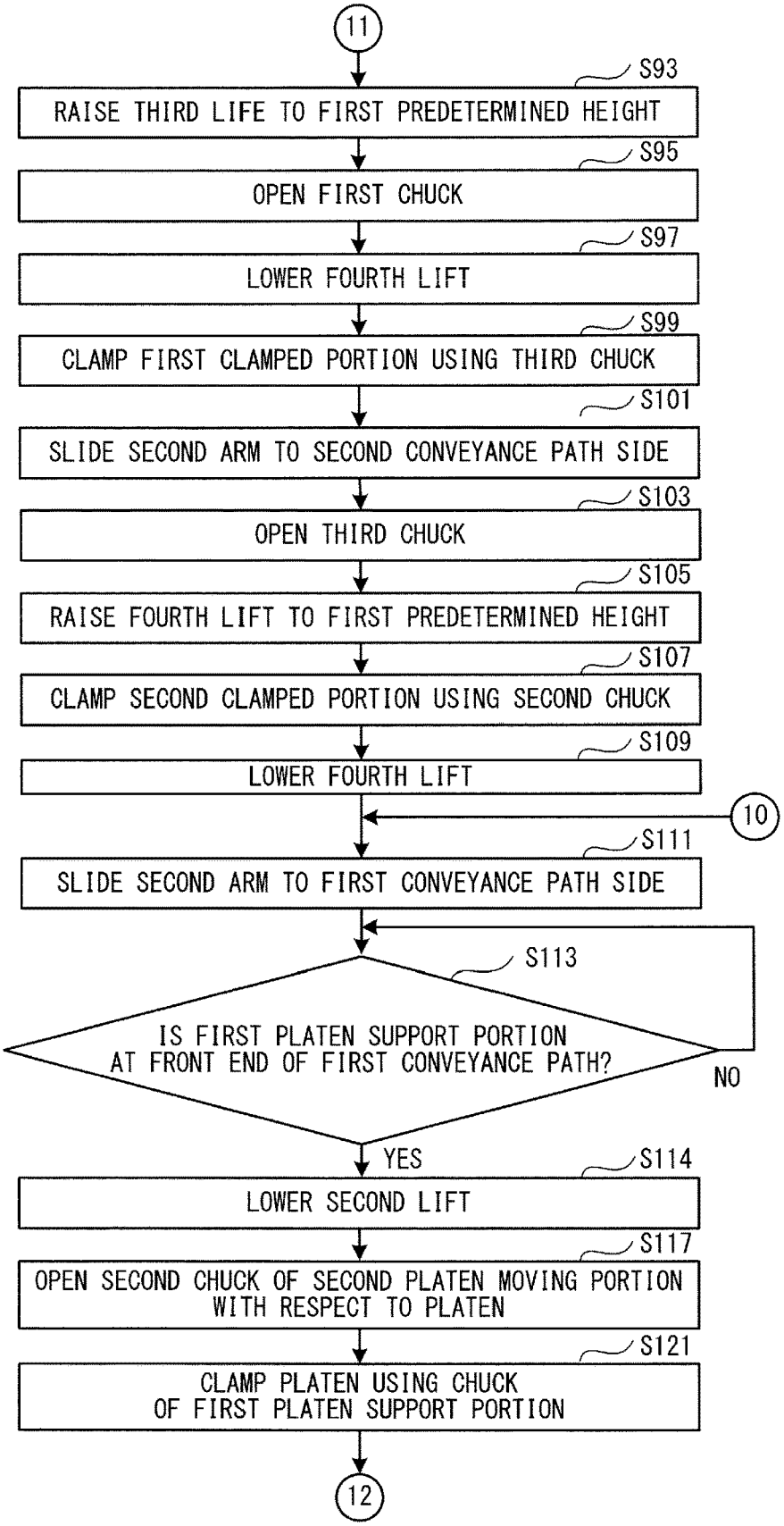
FIG. 12 is a fourth section of the flowchart of the second main processing.

In accordance with the embodiments and the modified examples, the electrical configuration of the print device 1 may be different from that shown in FIG. 4, and other hardware of a standard or type differing from that exemplified in FIG. 4 can be applied to the print device 1.

For example, a control portion of the print device 1 shown in FIG. 4 may be realized by a hardware circuit. For example, in place of the CPU 11, the control portion may be realized by a reconfigurable circuit, such as an FPGA and the like, or an ASIC and the like. The control portion may be realized by both the CPU 11 and the hardware circuit.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A platen conveyance device comprising:

a platen including a neckline guide portion configured to support a neckline of a shirt and configured to guide a position of the neckline of the shirt;

a first platen support portion configured to support the platen;

a first conveyance path configured to movably guide the first platen support portion in a first direction;

a first processing portion positioned partway along the first conveyance path and configured to perform first processing on the shirt;

a second platen support portion configured to support the platen;

a second conveyance path configured to movably guide the second platen support portion in the first direction;

a second processing portion positioned partway along the second conveyance path and configured to perform, on the shirt, second processing that is different from the first processing by the first processing portion; and a platen moving portion provided with at least one of a first platen moving portion and a second platen moving portion, the first platen moving portion being configured to move the platen which is supported by the first platen support portion to the second platen support portion, with the neckline guide portion positioned on a first side, the second platen moving portion being configured to move the platen which is supported by the second platen support portion to the first platen support portion, with the neckline guide portion positioned on the first side.

2. The platen conveyance device according to claim 1, wherein a plurality of the platens are placed on the platen moving portion, and the platen moving portion sequentially moves the plurality of the platens to the other of the first platen support portion and the second platen support portion, with the neckline guide portion positioned on the first side.

3. The platen conveyance device according to claim 1, wherein at least one of the first platen moving portion and the second platen moving portion moves the platen by horizontally sliding in a direction orthogonal to the first direction.

4. The platen conveyance device according to claim 1, wherein at least one of the first platen moving portion and the second platen moving portion moves the platen by horizontally sliding in a direction orthogonal to the first direction.

5. The platen conveyance device according to claim 1, wherein the second platen moving portion is positioned further to the first side in the first direction than the first processing portion and the second processing portion, a setting position of the shirt is positioned at one of the second platen moving portion and the first platen support portion in a case in which the first processing portion performs the processing first, and a setting position of the shirt is positioned at one of the second platen moving portion and the second platen support portion in a case in which the second processing portion performs the processing first.

6. The platen conveyance device according to claim 1, wherein the second platen moving portion is positioned further to the front side in the first direction than the first processing portion and the second processing portion, a removal position of the shirt is positioned at one of the second platen moving portion and the first platen support portion in a case in which the first processing portion performs the processing lastly, and a removal position of the shirt is positioned at one of the second platen moving portion and the second platen support portion in a case in which the second processing portion performs the processing lastly.

7. The platen conveyance device according to claim 1, wherein at least one of the first processing portion and the second processing portion is a print portion configured to perform print processing that prints on the shirt by ejecting ink.

8. The platen conveyance device according to claim 7, wherein the print portion includes:

a first ejection portion configured to eject background ink used to form a background on the shirt; and a second ejection portion configured to eject color ink, and provided further downstream than the first ejection portion.

9. The platen conveyance device according to claim 7, further comprising:

a reservoir portion provided further to the first side in the first direction than the print portion, and configured to store at least one of a recording material supplied to the print portion and a functional ink supplied to one of the print portion and a processing portion different to the print portion.

10. The platen conveyance device according to claim 1, further comprising:

a reception portion configured to receive a single operation by an operator;

a processor; and a memory configured to store computer-readable instructions that, when executed by the processor, perform a process comprising:

continuously performing processing of the first processing portion and the second processing portion when the single operation is received by the reception portion.

11. The platen conveyance device according to claim 1, further comprising:

an operation portion provided further to the first side in the first direction than the first processing portion and the second processing portion, and configured to operate the platen conveyance device.

12. A platen moving device configured to be attached to a platen conveyance device, the platen conveyance device including;

a platen including a neckline guide portion configured to support a neckline of a shirt and configured to guide a position of the neckline of the shirt;

a first platen support portion configured to support the platen;

a first conveyance path configured to movably guide the first platen support portion in a first direction;

a first processing portion positioned partway along the first conveyance path and configured to perform first processing on the shirt;

a second platen support portion configured to support the platen;

a second conveyance path configured to movably guide the second platen support portion in the first direction; and a second processing portion positioned partway along the second conveyance path and configured to perform, on the shirt, second processing that is different from the first processing by the first processing portion, the platen moving device comprising:

a platen moving portion provided with at least one of a first platen moving portion and a second platen moving portion, the first platen moving portion being configured to move the platen which is supported by the first platen support portion to the second platen support portion, with the neckline guide portion positioned on a first side, the second platen moving portion being configured to move the platen which is supported by the second platen support portion to the first platen support portion, with the neckline guide portion positioned on the first side.

13. The platen moving device according to claim 12, wherein the platen moving portion includes:

a transfer portion configured to receive the platen from one of the first platen support portion and the second platen support portion, and transfer the received platen to the other of the first platen support portion and the second platen support portion; and a support portion configured to movably support the transfer portion.

* * * * *